US009680235B2

(12) United States Patent
Kawamura et al.

(10) Patent No.: US 9,680,235 B2
(45) Date of Patent: Jun. 13, 2017

(54) INSULATED WIRE-TERMINAL CONNECTION STRUCTURE, WIRE HARNESS, AND INSULATED WIRE-TERMINAL CONNECTION METHOD

(71) Applicants: Furukawa Electric Co., LTD., Tokyo (JP); Furukawa Automotive Systems Inc., Inukami-gun (JP)

(72) Inventors: Yukihiro Kawamura, Tokyo (JP); Takashi Tonoike, Tokyo (JP); Satoshi Takamura, Tokyo (JP); Takeshi Hyotani, Tokyo (JP); Koichi Kitagawa, Tokyo (JP); Eiji Aramaki, Tokyo (JP)

(73) Assignees: Furukawa Electric Co., LTD., Tokyo (JP); Furukawa Automotive Systems Inc., Inukami-gun (JP)

( * ) Notice: Subject to any disclaimer, the term of this patent is extended or adjusted under 35 U.S.C. 154(b) by 0 days.

(21) Appl. No.: 14/692,399

(22) Filed: Apr. 21, 2015

(65) Prior Publication Data

US 2015/0229039 A1 Aug. 13, 2015

Related U.S. Application Data

(63) Continuation of application No. PCT/JP2013/078666, filed on Oct. 23, 2013.

(30) Foreign Application Priority Data

Oct. 23, 2012 (JP) ..... 2012-233403
Feb. 23, 2013 (JP) ..... 2013-033993

(51) Int. Cl.
*H01R 9/05* (2006.01)
*H01R 4/20* (2006.01)
(Continued)

(52) U.S. Cl.
CPC ..... *H01R 4/203* (2013.01); *H01B 7/0045* (2013.01); *H01R 4/20* (2013.01); *H01R 4/206* (2013.01);
(Continued)

(58) Field of Classification Search
CPC ..... H01B 7/36
(Continued)

(56) References Cited

U.S. PATENT DOCUMENTS 3,197,554 A * 7/1965 Baker ..... H01B 7/365 139/425 R
4,781,619 A * 11/1988 Ikeda ..... H01R 13/465 29/748
(Continued)

FOREIGN PATENT DOCUMENTS

CN 101194325 A 6/2008
JP 56-013685 A 2/1981
(Continued)

OTHER PUBLICATIONS

Office Action dated Aug. 5, 2014, in Japanese Patent Application No. 2014-078835.
(Continued)

*Primary Examiner* — William H Mayo, III
(74) *Attorney, Agent, or Firm* — Oblon, McClelland, Maier & Neustadt, L.L.P.

(57) ABSTRACT

In a terminal connection method of inserting a wire tip of an insulated wire, which is formed by stripping a front end of an insulating cover to expose an aluminum core wire, into a pressure-bonding section of a female crimp terminal to pressure bond the insulated wire to the female crimp terminal via the pressure-bonding section, signs are formed on the outer circumferential face of an insulated tip of the insulating cover at a distance of an internal length of the pressure-
(Continued)

bonding section from a conductor tip face of the conductor tip, and the wire tip is inserted up to the signs in the pressure-bonding section to pressure-bond the wire tip to the pressure-bonding section.

18 Claims, 13 Drawing Sheets

(51) Int. Cl.
*H01R 4/62* (2006.01)
*H01B 7/00* (2006.01)
*H01R 43/05* (2006.01)
*H01R 43/048* (2006.01)
*H01R 43/28* (2006.01)

(52) U.S. Cl.
CPC ..... *H01R 4/62* (2013.01); *H01R 43/05* (2013.01); *H01R 43/048* (2013.01); *H01R 43/28* (2013.01)

(58) Field of Classification Search
USPC ..... 174/110 R, 113 R, 112
See application file for complete search history.

(56) References Cited

U.S. PATENT DOCUMENTS

| | | | | |
|---|---|---|---|---|
| 5,142,105 | A * | 8/1992 | Kihlken | H01B 13/341 174/112 |
| 5,281,764 | A * | 1/1994 | King | H01B 7/361 174/112 |
| 5,862,774 | A * | 1/1999 | Moss | H01B 7/368 116/200 |
| 6,437,248 | B1 * | 8/2002 | Giebel | G02B 6/4482 174/110 R |
| 6,498,301 | B1 * | 12/2002 | Pieper | H01B 7/365 174/112 |
| 7,211,733 | B2 * | 5/2007 | Kurimoto | H01B 7/365 174/110 R |
| 7,442,877 | B2 * | 10/2008 | Kamata | H01B 13/345 174/110 R |
| 7,482,539 | B2 * | 1/2009 | Katsumata | H01B 7/361 174/110 R |
| 8,513,526 | B2 * | 8/2013 | Sugimura | H01B 7/361 174/112 |
| 2006/0225909 | A1 | 10/2006 | Kurimoto et al. | |
| 2009/0211780 | A1 * | 8/2009 | Auphand | H01B 7/36 174/68.1 |

FOREIGN PATENT DOCUMENTS

| | | | |
|---|---|---|---|
| JP | 03-245413 | | 11/1991 |
| JP | 2004-071437 | A | 3/2004 |
| JP | 2004-71437 | A | 3/2004 |
| JP | 2004-335251 | A | 11/2004 |
| JP | 2005-339850 | A | 12/2005 |
| JP | 2008-547159 | A | 12/2008 |
| JP | 2009-176571 | A | 8/2009 |
| WO | WO 2011/122622 | A1 | 10/2011 |

OTHER PUBLICATIONS

International Search Report mailed Dec. 24, 2013 for PCT/JP2013/078666 filed Oct. 23, 2013 with English Translation.
Office Action drafted Apr. 18, 2014 in Japanese Patent Application No. 2014-506658 (with unedited computer generated English translation).
Office Action drafted Sep. 17, 2014 in Japanese Patent Application No. 2014-078835 (with unedited computer generated English translation).
Office Action issued Nov. 26, 2014 in Korean Patent Application No. 10-2014-7021136 (with English language translation).
Office Action issued Jul. 15, 2015 in Chinese Patent Application No. 201380008570.9 (with English language translation).
Combined Chinese Office Action and Search Report issued Jan. 30, 2015 in Patent Application No. 201380008570.9 (with English language translation).
Office Action issued Mar. 20, 2014 in Japanese Patent Application No. 2014-506658 (with English language translation).

* cited by examiner

INSULATED WIRE-TERMINAL CONNECTION STRUCTURE, WIRE HARNESS, AND INSULATED WIRE-TERMINAL CONNECTION METHOD

This application is a continuation application of PCT International Application No. PCT/JP2013/078666 filed Oct. 23, 2013, which claims priority to Japanese Application No. 2012-233403 filed Oct. 23, 2012 and Japanese Application No. 2013-033993 filed Feb. 23, 2013, each of which are herein incorporated by reference in their entity for all purposes.

TECHNICAL FIELD

The present invention relates to an insulated wire-terminal connection structure attached to, for example, a connector of a vehicle wire harness, a wire harness, and a connection method.

BACKGROUND ART

Electrical equipment provided in vehicles and the like is connected to another electrical equipment or power supply via a wire harness including bundled insulated wires to constitute an electrical circuit. In this case, the wire harness is connected to the electrical equipment or power supply via the respective connectors.

Various crimp terminals provided in the connector have been proposed, and a crimp terminal disclosed in Patent Document 1 is an example of the crimp terminals.

In the crimp terminal disclosed in Patent Document 1, a wire tip formed by stripping a front end of an insulating cover on an insulated wire to expose a conductor is inserted into an insertion hole of a pressure-bonding section having a closed front end, thereby pressure-bonding the pressure-bonding section to the wire tip.

However, since the insertion hole of the pressure-bonding section is small, and the front end of the insertion hole is closed, when the wire tip is inserted into the insertion hole of the pressure-bonding section, one cannot ensure whether or not the conductor of the wire tip is inserted into the insertion hole of the pressure-bonding section by a proper depth from the outside of the pressure-bonding section. When the wire tip is insufficiently inserted into the insertion hole of the conductor, the desired conductive state cannot be achieved due to the improper pressure-bonding of the conductor to the pressure-bonding section.

PRIOR ART DOCUMENT

Patent Document

Patent Document 1: Japanese Patent Laid-open Publication No. 2009-176571

SUMMARY OF THE INVENTION

Problems to be Solved by the Invention

An object of the present invention is to provide an insulated wire-terminal connection structure, a wire harness, and an insulated wire-terminal connection method that enable reliably visually confirming that a conductor of a wire tip of an insulated wire is inserted to a predetermined position in a pressure-bonding section of a crimp terminal, from the outside of the pressure-bonding section.

Solutions to the Problems

The present invention provides an insulated wire-terminal connection structure including: an insulated wire formed by covering a conductor with an insulating cover, the insulated wire having a wire tip formed by stripping an front end of the insulating cover to expose the conductor; and a crimp terminal having a pressure-bonding section that allows at least pressure-bonding of the wire tip, the insulated wire and the crimp terminal being pressure-bonded to each other via the pressure-bonding section, wherein a tip-side outer circumferential face of the insulating cover has a sign indicating that the wire tip is inserted into the pressure-bonding section by a predetermined length according to an insertion length of the wire tip into the pressure-bonding section, the sign is made of a material that is more flexible than the insulating cover, formed by stripping the insulating cover by a length less than the internal length of the pressure-bonding section, arranged to cover the outer circumferential face of the insulating cover in a circumferential direction so as to be wide in a long length direction of the insulated wire, has a width including a position at a distance of the internal length of the pressure-bonding section from the tip face of the wire tip, the width corresponding to a range in which a conductor tip of the exposed conductor is pressure-bonded to the pressure-bonding section in a desired conductive state, and the wire tip inserted up to the sign is pressure-bonded to the pressure-bonding section.

According to the present invention, one can visually confirm that the conductor of the wire tip of the insulated wire is inserted to the predetermined position in the pressure-bonding section of the crimp terminal, from the outside of the pressure-bonding section.

This will be described in more detail. For example, when the wire tip formed by stripping the front end of the insulating cover on the insulated wire to expose the conductor by the predetermined length is inserted into the pressure-bonding section having the closed front end, one cannot confirm whether or not the conductor exposed on the wire tip is inserted into the pressure-bonding section by the proper length, from the outside of the pressure-bonding section. Thus, when the conductor is insufficiently inserted, the desired conductive state cannot be achieved due to improper pressure-bonding of the conductor to the pressure-bonding section.

In contrast, in the insulated wire-terminal connection structure of the present invention, since the sign indicating the insertion length of the wire tip into the pressure-bonding section is arranged on the tip-side of the outer circumferential face of the insulating cover according to the insertion length of the wire tip into the pressure-bonding section, by inserting the wire tip of the insulated wire up to the sign in the pressure-bonding section of the crimp terminal, the conductor exposed on the wire tip can be inserted to the predetermined position in the closed-barrel type or opened-barrel type pressure-bonding section correctly and reliably.

When the wire tip is inserted into the pressure-bonding section until the center of the sign coincides with the rear end of the pressure-bonding section, merely by visually checking the sign exposed from the pressure-bonding section, one can reliably visually confirm that the conductor of the wire tip is inserted to the predetermined position in the pressure-bonding section, from the outside of the pressure-bonding section, thereby preventing the conductor of the wire tip from being insufficiently or excessively inserted into the pressure-bonding section.

As a result, the conductor of the wire tip of the insulated wire can be pressure-bonded to the pressure-bonding section of the crimp terminal in the predetermined pressure-bonding state to constitute the terminal connection structure in the desired conductive state.

When the wire tip is insufficiently inserted into the pressure-bonding section, the contact area between the conductor tip without the cover and the pressure-bonding section becomes small, possibly failing to achieve the stable conductive state.

Since the pressure-bonding area of closed-barrel type pressure-bonding section that crimps the insulating cover is small and thus, the contact length between the insulated wire and the crimp terminal is reduced, entrance of water from the rear end into the terminal cannot be blocked, possibly lowering the water-blocking performance.

However, according to the present invention, when the conductor exposed on the wire tip is inserted to the predetermined position in the pressure-bonding section, the insulating cover is also inserted into the pressure-bonding section by a predetermined length, ensuring the area necessary for pressure-bonding. As a result, the contact length necessary for keeping the connection between the insulated wire and the crimp terminal can be acquired to lead to a stable conductive state.

The sign is formed by stripping the insulating cover by a length less than the internal length of the pressure-bonding section; therefore, one can visually confirm that the wire tip is inserted by the length corresponding to the internal length of the pressure-boding section from the outside of the pressure-bonding section.

This will be described in more detail. For example, for the closed-barrel type crimp terminal, a slope is present between the pressure-bonding section pressure-bonded to the wire tip and the sealing portion sealed by adhering the opposed inner faces of the pressure-bonding section. Thus, when the wire tip of the insulated wire is inserted from the rear opening of the pressure-bonding section to the end of the front sealing portion, the insertion amount of the wire tip varies depending on the inclination of the slope, failing to achieve the predetermined pressure-bonding state.

In contrast, in the terminal connection structure of the present invention, since the sign is formed by stripping the insulating cover having a length less than the internal length of the pressure-bonding section, and arranged at the distance of the internal length of the pressure-bonding section from the tip face of the wire tip, by inserting the wire tip of the insulated wire up to the sign in the pressure-bonding section of the crimp terminal, the conductor exposed on the wire tip can be inserted to the predetermined position where the tip face of the wire tip reaches the end of the pressure-bonding section correctly and reliably.

The wire tip herein includes the conductor tip formed by stripping the front end of the insulating cover on the insulated wire to expose the conductor, and the insulated tip of the insulating cover to which the pressure-bonding section is pressure-bonded. The pressure-bonding section is, for example, a substantially cylindrical pressure-bonding section of a closed-barrel type or a substantially V-like pressure-bonding section of opened-barrel type, in the pre-pressure-bonding state.

For example, a concave or convex serration may be formed on the inner face of the pressure-bonding section pressure-bonded to the conductor exposed on the wire tip, and in this case, the conductor pressure-bonded to the inner face of the pressure-bonding section via the pressure-bonding section engages with the serration and is deformed. As a result, the contact area increases to achieve electrical connection with a small electrical resistance.

The above-mentioned position of the sign may be changed to any desired position according to the insertion length of the wire tip into the pressure-bonding section.

The sign may be arranged to be wide in the long length direction of the insulated wire, and have a width including a position at the distance of the internal length of the pressure-bonding section from the tip face of the wire tip, the width corresponding to a range in which a conductor tip of the exposed conductor is pressure-bonded to the pressure-bonding section in a desired conductive state. With this configuration, merely by visually checking the sign exposed from the pressure-bonding section, one can visually confirm that the wire tip is inserted into the pressure-bonding section by a predetermined length, from the outside of the pressure-bonding section.

This will be described in more detail. For example, when the wire tip of the insulated wire is inserted into the pressure-bonding section, if the sign formed on the wire tip is hidden behind the pressure-bonding section, the sign cannot be visually checked and therefore, one cannot ensure that the conductor exposed on the wire tip is inserted to the predetermined position in the pressure-bonding section.

In contrast, in the insulated wire-terminal connection structure of the present invention, the sign is arranged to be wide in the long length direction of the insulated wire, and has the width including the position at the distance of the internal length of the pressure-bonding section from the tip face of the wire tip, the width corresponding to the range in which the conductor tip of the exposed conductor is pressure-bonded to the pressure-bonding section in the desired conductive state.

When the wire tip is inserted into the pressure-bonding section, if at least the rear end of the wide sign is exposed from the pressure-bonding section, and the front end of the sign is hidden behind the pressure-bonding section, the conductor exposed on the wire tip is inserted to the predetermined position in the pressure-bonding section.

If the front end of the sign is exposed from the pressure-bonding section, the conductor tip is located in the rear of the range in which the pressure-bonding section can be pressure-bonded, that is, the wire tip is insufficiently inserted into the pressure-bonding section.

Accordingly, by inserting the wire tip of the insulated wire into the pressure-bonding section until at least the rear end of the sign is exposed from the pressure-bonding section and the front end of the sign is hidden behind the pressure-bonding section, the conductor can be reliably inserted to the predetermined position in the pressure-bonding section.

Further, by visually checking the width of the sign exposed from the pressure-bonding section, one can visually confirm that the conductor is inserted to the predetermined position in the pressure-bonding section, from the outside of the pressure-bonding section.

The sign may be formed to have a width corresponding to the range in which the conductor tip contacts the whole section of the pressure-bonding section which corresponds to the conductor tip, and in this case, when the front end of the sign is invisible behind the pressure-bonding section when the wire tip is inserted into the pressure-bonding section, one can visually confirm that at least the front end of the conductor tip falls within the range in which the pressure-bonding section can be pressure-bonded from the outside of the pressure-bonding section.

When the rear end of the sign is partially visible from the outside of the pressure-bonding section, by visually checking the exposed sign, one can visually confirm that the substantially whole conductor tip falls within the range in which the pressure-bonding section can be pressure-bonded from the outside of the pressure-bonding section.

Further, the sign may be made of a material that is more flexible than the insulating cover, and may be arranged so as to cover the outer circumferential face of the insulating cover in the circumferential direction. With this configuration, the sign for visually ensuring that the wire tip is inserted to the predetermined position in the pressure-bonding section can be also used to achieve the water-blocking performance for blocking water between opposed faces of the insulated wire and the pressure-bonding section.

This will be described in more detail. For example, when the wire tip is directly pressure-bonded to the pressure-bonding section, water may enter from the gap between the insulating cover and the pressure-bonding section.

In contrast, in the insulated wire-terminal connection structure of the present invention, since the sign is made of the material that is more flexible than the insulating cover, and is arranged so as to cover the outer circumferential face of the insulating cover in the circumferential direction, when the wire tip of the insulated wire is inserted up to the sign in the pressure-bonding section of the crimp terminal, and the wire tip is pressure-bonded to the pressure-bonding section using a pressure-bonding tool not shown, unlike the case where the pressure-bonding section is directly pressure-bonded to the insulated wire, the highly flexible sign has a high conformance to shape variation and thus, is easily deformed into the pressure-bonded shape, such that the opposed faces of the wire tip and the pressure-bonding section are adhered to each other, thereby blocking water.

As a result, water can be prevented from entering into the pressure-bonding section, ensuring a good water-Hocking performance.

Further, when the wire tip is inserted into the pressure-bonding section until the flexible sign is partially exposed from the pressure-bonding section and partially hidden behind the pressure-bonding section, by visually checking the exposed portion of the sign, one can ensure that the conductor is inserted to the predetermined position in the pressure-bonding section from the outside of the pressure-bonding section.

Examples of the flexible material include rubber, gel, adhesives, and tackiness agents.

The internal length of the pressure-bonding section herein corresponds to a internal length in the long length direction of the pressure-bonding section having a substantially cylindrical cross section in the wire insertion direction in the closed-barrel type crimp terminal. The internal length corresponds to a long length direction of the pressure-bonding section having a substantially U-like cross section in the wire insertion direction in the pre-pressure-bonding state in the opened-barrel type crimp terminal.

The tip face of the wire tip may be a tip face of the conductor tip or a tip face of the insulated tip.

The range of the pressure-bonding in the desired conductive state corresponds to a range in which the conductor tip formed by exposing the conductor by the predetermined length in the wire tip is pressure-bonded to the pressure-bonding section. That is, the conductor tip contacts the whole section of the pressure-bonding section which corresponds to the conductor tip.

From an aspect of the present invention, the pressure-bonding section may be formed into a hollow shape having an inner space capable of receiving the wire tip inserted, the a hollow shape capable of surrounding the wire tip.

With the above-mentioned configuration, for example, it is difficult to visually check the wire tip inserted into the closed-barrel type pressure-bonding section from the outside of the pressure-bonding section. However, by adopting the terminal connection structure of the present invention, one can reliably visually confirm that the conductor exposed on the wire tip is inserted to the predetermined position in the pressure-bonding section, from the outside of the pressure-bonding section.

From an aspect of the present invention, the front end of the pressure-bonding section may be provided with a sealing portion sealed by adhering opposed inner faces of the pressure-bonding section to each other.

With the above-mentioned configuration, since the front end of the pressure-bonding section is sealed with the sealing portion, one cannot visually check the wire tip inserted into the pressure-bonding section from the front end of the pressure-bonding section to ensure whether or not the wire tip is properly inserted into the pressure-bonding section.

However, by adopting the insulated wire-terminal connection structure of the present invention, one can reliably visually confirm that the conductor exposed on the wire tip is inserted to the predetermined position in the pressure-bonding section having the front end sealed with the sealing portion, from the outside of the pressure-bonding section.

Further, since the sealing portion is formed by adhering the opposed inner faces of the pressure-bonding section to each other, water can be prevented from entering into the pressure-bonding section from the front end of the pressure-bonding section, ensuring stable conductivity.

The sealing portion sealed by adhering the inner faces to each other as described above may be fixed in the width direction by welding. The widthwise fixation of the sealing portion by welding can improve the water-blocking performance of the sealing portion.

From an aspect of the present invention, the conductor may be made of an aluminum-based material, and at least the pressure-bonding section may be made of a copper-based material.

According to the present invention, this insulated wire is lighter than an insulated wire having a conductor of a copper wire, and has the reliable water-blocking performance due to the presence of the sealing portion to prevent so-called dissimilar metal contact corrosion (hereinafter referred to as galvanic corrosion).

This will be described in more detail. In the case where a copper-based material conventionally used for the conductor of the insulated wire is replaced with an aluminum-based material such as aluminum or an aluminum alloy, and the conductor made of the aluminum-based material is pressure-bonded to the crimp terminal, the aluminum-based material as a less noble metal may disadvantageously corrodes through contact with the terminal made of a nobler metal material such as tin-plating, gold-plating, or copper alloy, which is called as galvanic corrosion.

The galvanic corrosion is a phenomenon that water adheres to the contact area between the nobler metal material and the less noble metal to cause a corrosion electric current corroding, melting, or eliminating the less noble metal. Through this phenomenon, the conductor made of the aluminum-based material, which is pressure-bonded to the pressure-bonding section of the crimp terminal, corrodes, melts, and is eliminated and then, an electrical resistance rises. This disadvantageously causes an inadequate conductive function.

However, by pressure-bonding the conductor while remaining inserted to the predetermined position in the pressure-bonding section, the weight can be reduced as compared to the insulated wire having the conductor made of the copper-based material, and furthermore, the galvanic corrosion can be prevented.

As a result, irrespective of the metal type of the crimp terminal and the conductor of the insulated wire, the connection state with stable conductivity can be realized.

The pressure-bonding section may be made of a copper-based material such as copper or a copper alloy. The conductor may be formed of aluminum raw wires or aluminum alloy raw wires.

The present invention provides a wire harness in which the crimp terminal of the insulated wire-terminal connection structure is arranged in a connector housing.

The wire harness may be configured of the plurality of terminal connection structures or one terminal connection structure.

According to the present invention, the connection state with reliable conductivity can be ensured.

Furthermore, the present invention provides an insulated wire-terminal connection method including: inserting a wire tip of an insulated wire, the wire tip being formed by stripping a front end of an insulating cover covering a conductor to expose the conductor, into a pressure-bonding section of a crimp terminal to pressure-bond the insulated wire to the crimp terminal via the pressure-bonding section, wherein the wire tip is configured of a conductor tip formed by stripping the front end of the insulating cover on the insulated wire to expose the conductor by a predetermined length and an insulated tip in the rear of the conductor tip of the insulating cover, the method further including: in an outer circumferential face of the insulated tip, forming a sign at a position located at a distance corresponding to an insertion length of the wire tip into the pressure-bonding section from a tip face of the wire tip; forming the sign after stripping the insulating cover having a length less than the internal length of the pressure-bonding section to expose the conductor; and pressure-bonding the wire tip inserted up to the sign to the pressure-bonding section.

According to the present invention, one can reliably visually confirm that the conductor of the wire tip of the insulated wire is inserted to the predetermined position in the pressure-bonding section of the crimp terminal, from the outside of the pressure-bonding section, and the wire tip can be pressure-bonded to the pressure-bonding section in the predetermined pressure-bonding state.

This will be described in more detail. For example, when the wire tip formed by stripping the front end of the insulating cover on the insulated wire to expose the conductor by the predetermined length is inserted into the pressure-bonding section having the closed front end, one cannot visually confirm whether or not the conductor exposed from the front end of the insulated wire is properly inserted into the pressure-bonding section, from the outside of the pressure-bonding section.

In contrast, in the insulated wire-terminal connection method of the present invention, since the sign is formed on the outer circumferential face of the insulated tip at the distance corresponding to the insertion length of the wire tip into the pressure-bonding section from the tip face of the wire tip, by inserting the wire tip of the insulated wire up to the sign in the pressure-bonding section of the crimp terminal, the conductor exposed on the wire tip can be inserted to the predetermined position in the closed-barrel type or opened-barrel type pressure-bonding section correctly and reliably.

Further, since the conductor of the wire tip inserted to the predetermined position is pressure-bonded to the pressure-bonding section, the conductor can be pressure-bonded to the pressure-bonding section in the predetermined pressure-bonding state, achieving the desired conductive state.

When the wire tip of the insulated wire is inserted up to the sign in the pressure-bonding section of the crimp terminal, for example, by inserting the wire tip until the sign is partially exposed from the pressure-bonding section and partially hidden behind the pressure-bonding section, the conductor exposed on the wire tip can be inserted to the predetermined position in the pressure-bonding section.

In order to form the sign by stripping the insulating cover having a length less than the internal length of the pressure-bonding section to expose the conductor, and pressure-bond the wire tip inserted up to the sign to the pressure-bonding section, since the sign is formed at the distance of the internal length of the pressure-bonding section from the tip face of the wire tip, when the wire tip is inserted into the pressure-bonding section until the center of the sign coincides with the rear end of the pressure-bonding section, merely by visually checking the sign exposed from the pressure-bonding section, one can reliably visually confirm that the conductor exposed on the wire tip is inserted to the predetermined position in the pressure-bonding section, from the outside of the pressure-bonding section, and the conductor exposed on the wire tip can be inserted to the predetermined position in the pressure-bonding section correctly and reliably.

One can reliably visually confirm that the conductor of the wire tip of the insulated wire is inserted to the predetermined position in the pressure-bonding section of the crimp terminal from the outside of the pressure-bonding section, and the wire tip can be pressure-bonded to the pressure-bonding section in the predetermined pressure-bonding state.

Effects of the Invention

The present invention can provide an insulated wire-terminal connection structure, a wire harness, and an insulated wire-terminal connection method that enable reliably visually confirming that a conductor of a wire tip of an insulated wire is inserted to a predetermined position in a pressure-bonding section of a crimp terminal from the outside of the pressure-bonding section, and enable pressure-bonding of the wire tip to the pressure-bonding section in a predetermined pressure-bonding state.

EMBODIMENTS OF THE INVENTION

An embodiment of the present invention will be described below with reference to the drawings.

First Embodiment

Figure 1A:
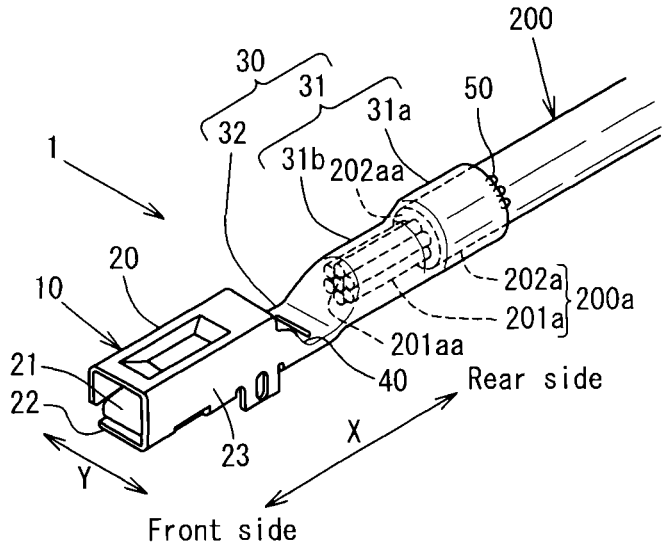
FIGS. 1A and 1B are views illustrating a wire with a female crimp terminal in a first embodiment.
Figure 1B:
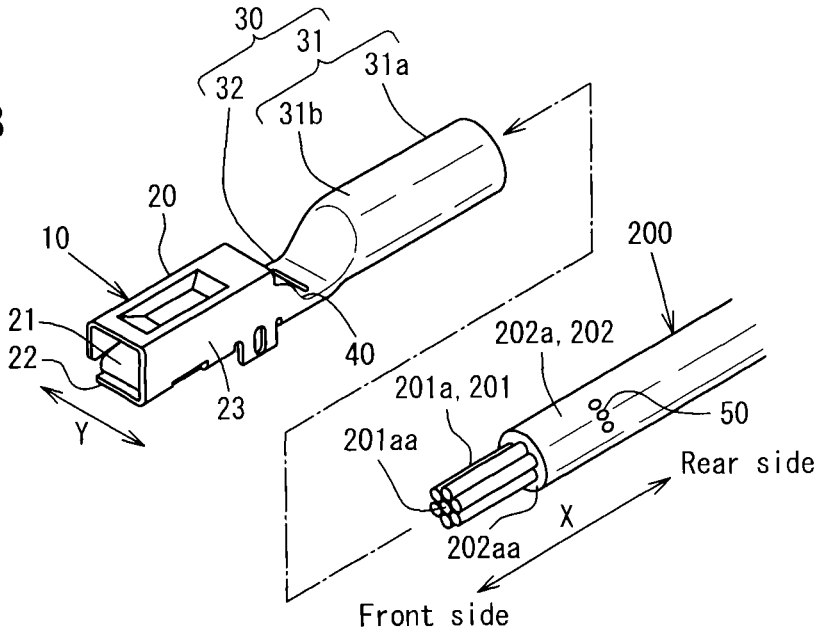

The drawings show a terminal connection structure in which a female crimp terminal 10 is pressure-bonded to an insulated wire 200, FIGS. 1A and 1B are views illustrating a wire 1 with female crimp terminal in a first embodiment. This will be described in more detail. FIG. 1A is a perspective view of the female crimp terminal 10 and the insulated wire 200 that are pressure-bonded to each other, and FIG. 1B is a perspective view of the female crimp terminal 10 and the insulated wire 200 in the state immediately before a wire tip 200*a* is inserted into a pressure-bonding section 30.

Figure 2A:
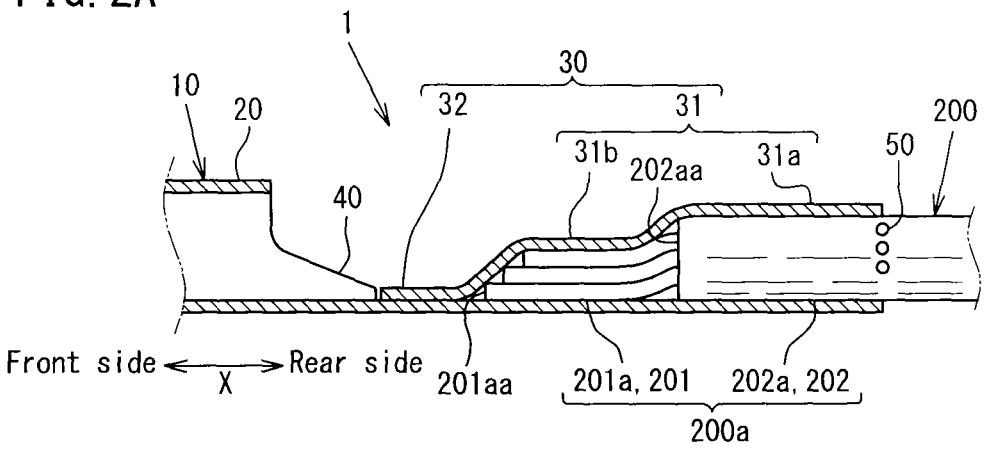
FIGS. 2A and 2B are vertical sectional views showing the widthwise center of a pressure-bonding section of the wire with female crimp terminal.
Figure 2B:
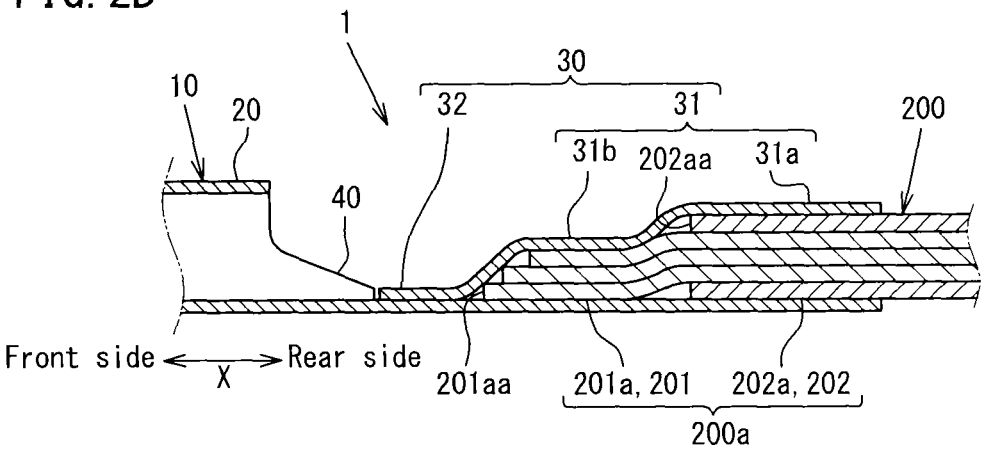

FIGS. 2A and 2B are vertical sectional views showing the widthwise center of the pressure-bonding section 30 of the wire 1 with female crimp terminal. This will be described in more detail. FIG. 2A is a sectional view showing a pressure-bonded shape of the pressure-bonding section 30 pressure-bonded to the wire tip 200*a*, and FIG. 2B is a sectional view showing the wire tip 200*a* and the pressure-bonding section 30 that are pressure-bonded to each other.

Figure 3A:
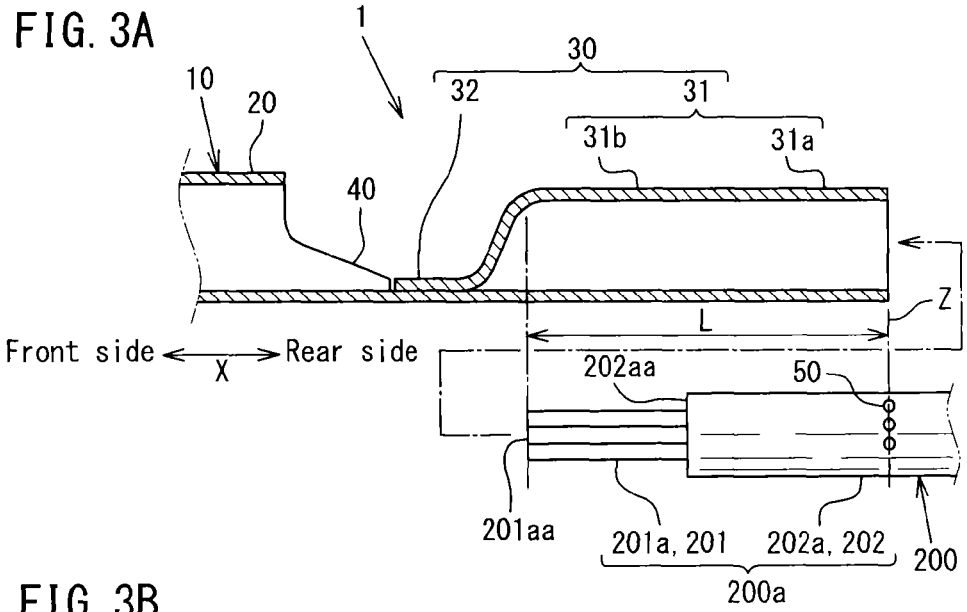
FIGS. 3A to 3C are views illustrating the procedure of inserting a wire tip having round signs into the pressure-bonding section.
Figure 3B:
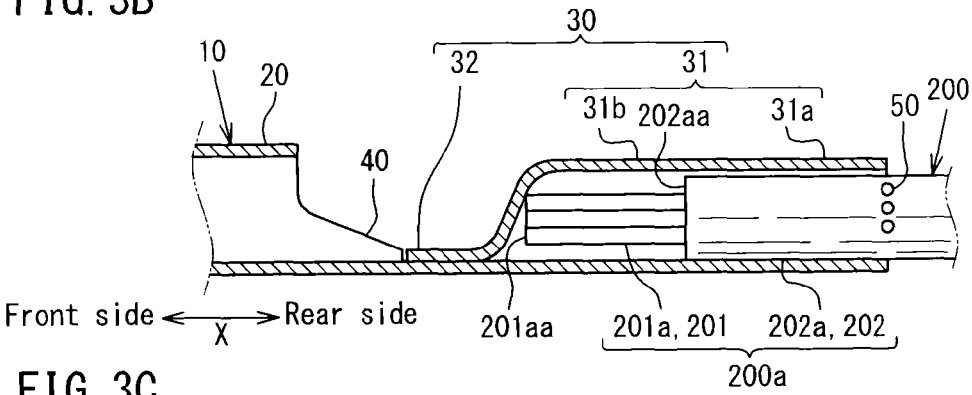
Figure 3C:
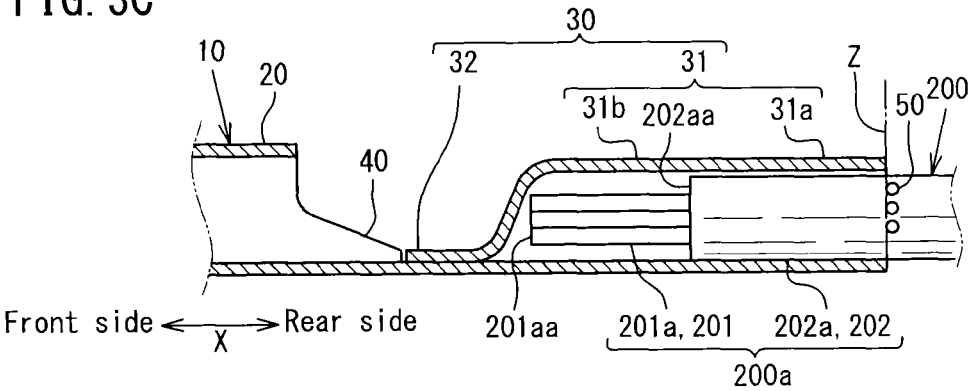

FIGS. 3A to 3C are views illustrating a procedure of inserting the wire tip 200*a* having round signs 50 into the pressure-bonding section 30. This will be described in more detail. FIG. 3A is a vertical sectional view showing the state immediately before the wire tip 200*a* is inserted into the pressure-bonding section 30, FIG. 3B is a vertical sectional view showing the state immediately after the wire tip 200*a* is inserted into the pressure-bonding section 30 up to the center of the signs 50, and FIG. 3C is a vertical sectional view showing the state where the wire tip 200*a* is inserted into the pressure-bonding section 30 with the substantially entire signs 50 exposed.

As shown in FIG. 1A and FIGS. 2A and 2B, the wire 1 with female crimp terminal in this embodiment is configured by connecting the insulated wire 200 to the female crimp terminal 10. That is, the wire tip 200*a* of the insulated wire 200 is pressure-bonded to the pressure-bonding section 30 of the female crimp terminal 10.

As shown in FIGS. 1A and 1B, the female crimp terminal 10 integrally includes a box section 20 that can receive an insertion tab of a male crimp terminal not shown, and the pressure-bonding section 30 located in the rear of the box section 20 across a transition section 40 having a predetermined length, rearward from the front end of the female crimp terminal 10 in a longitudinal direction X.

This will be described in more detail. The female crimp terminal 10 is formed of a copper alloy strip (not shown) made of, for example, tinned (Sn-plated) brass, and is a closed-barrel type terminal including the hollow quadrangular prism-like box section 20 when viewed from the front side in the longitudinal direction X and the substantially cylindrical pressure-bonding section 30 when viewed from the rear side in the longitudinal direction X. The pressure-bonding section of the male crimp terminal having the insertion tab to be inserted into the box section 20 has the same configuration.

As shown in FIGS. 1A and 1B, the longitudinal direction X is a direction corresponding to the longitudinal direction of the insulated wire 200 pressure-bonded to the pressure-bonding section 30, and a width direction Y is a direction intersecting the longitudinal direction X in a plane. The side of the box section 20 relative to the pressure-bonding section 30 is defined as the front side, and the side of the pressure-bonding section 30 relative to the box section 20 is defined as the rear side.

The box section 20 includes an elastic contact piece 21 that is bent toward the rear side in the longitudinal direction X and makes contact with the insertion tab (not shown) of the inserted male connector.

The box section 20 is configured to be substantially rectangular when viewed from the front end in the longitudinal direction X by bending side faces 23 connected to both sides of a bottom face 22 in the width direction Y orthogonal to the longitudinal direction X so as to overlap each other.

The pressure-bonding section 30 is an integral body continuous in the entire circumferential direction including a wire pressure-bonding section 31 and a sealing portion 32, which are connected to each other from the rear side to the front side.

The sealing portion 32 is an end flattened into a substantially flat plate shape in front of the wire pressure-bonding section 31, and is configured by an overlapped plate member forming the female crimp terminal 10. This can prevent water from entering into the pressure-bonding section 30 from the front end of the pressure-bonding section 30.

The wire pressure-bonding section 31 includes a cover pressure-bonding section 31*a* and a conductor pressure-bonding section 31*b* that are serially connected to each other in this order from the rear side to the front side. The wire pressure-bonding section 31 is configured of a hollow (cylindrical) body extending from the cover pressure-bonding section 31*a* to the conductor pressure-bonding section 31*b*, which is opened only on the rear end so as to receive the wire tip 200*a* (a conductor tip 201*a* and an insulated tip 202*a*) and is not opened on the front end and the entire circumferential face.

The cover pressure-bonding section 31*a* is a section of the wire pressure-bonding section 31 in the longitudinal direction X, and corresponds to the insulated tip 202*a* in the state where the wire tip 200*a* is inserted into the wire pressure-bonding section 31, and has a hollow shape capable of surrounding the insulated tip 202*a*.

The conductor pressure-bonding section 31*b* is a section of the wire pressure-bonding section 31 in the longitudinal direction X, and corresponds to the conductor tip 201*a* in the state where the wire tip 200*a* is inserted into the wire pressure-bonding section 31, and has a hollow shape capable of surrounding the conductor tip 201*a*.

The cover pressure-bonding section 31*a* and the conductor pressure-bonding section 31*b* are cylinders having the same diameter in the pre-pressure-bonding state.

The insulated wire 200 pressure-bonded to the female crimp terminal 10 is configured by covering an aluminum core wire 201 formed of bundled aluminum raw wires with an insulating cover 202 made of an insulating resin. This will be described in more detail. The aluminum core wire 201 is configured by bundling a plurality of aluminum alloy wires so as to have a cross section of 0.75 $mm^2$.

The wire tip 200*a* serially includes the insulated tip 202*a* of the insulating cover 202 and the conductor tip 201*a* of the aluminum core wire 201 toward the front side in this order, at the front end of the insulated wire 200.

The conductor tip 201*a* is formed by stripping the insulating cover 202 on the front end side of the insulated wire 200 by a predetermined length that is shorter than an internal length L of the pressure-bonding section 30 in the female crimp terminal 10 and corresponds to the conductor pressure-bonding section 31*b* of the wire pressure-bonding section 31 to expose the aluminum core wire 201 (see FIGS. 3A to 3C).

A range in which entire serrations that are electrically-connected portions of the conductor pressure-bonding section 31*b* are pressure-bonded to the conductor tip 201*a* exposed by the predetermined length (see FIGS. 10A and 10B) is set as a range pressure-bonded into a desired conductive state.

The insulated tip 202*a* is a front end section of the insulated wire 200, which is located in the rear of an insulated tip face 202*aa* and is formed by covering the aluminum core wire 201 with the insulating cover 202.

The outer circumferential face of the insulated tip 202*a* of the insulating cover 202 has the round signs 50 located at a distance of the internal length L of the pressure-bonding section 30 from a conductor tip face 201*aa* of the conductor tip 201*a* in the state where the wire tip 200*a* of the insulated wire 200 is inserted until the conductor tip face 201*aa* of the conductor tip 201*a* contacts the sealing-side inner wall face of the pressure-bonding section 30.

The signs 50 are marked at the distance of the internal length L of the pressure-bonding section 30 from the conductor tip face 201*aa* of the conductor tip 201*a* such that a virtual reference line Z set along the opening-side rear end of the pressure-bonding section 30 coincides with the center of the signs 50. The three signs 50 are arranged on the outer circumferential face of the insulated tip 202*a* at predetermined intervals in the circumferential direction (see FIG. 3A).

The internal length L of the pressure-bonding section 30 is set to a distance from the sealing-side inner wall face of the pressure-bonding section 30, against which the conductor tip face 201*aa* of the conductor tip 201*a* contacts, to the opening-side rear end of the pressure-bonding section 30, at which the insulated tip 202*a* of the insulating cover 202 is exposed.

The signs 50 are marked by irradiating the outer circumferential face of the insulated tip 202*a* of the insulating cover 202 with a laser radiated from a laser marker not shown at a laser marking rate of 1000 mm/s to change the color of at least a portion of the outer circumferential face of the insulated tip 202*a* so as to be distinguishable from the insulating cover 202 surrounding the signs 50 (for example, black or grey).

The use of a $CO_2$ laser as the laser radiated from the laser marker can reduce damage on the insulating cover 202 of the insulated wire 200 and ensure the water-blocking performance in the pressure-bonding state as compared to the case of a UV laser, because the $CO_2$ laser has a longer wavelength than the UV laser.

As an another example, by pressing an iron heated to a predetermined temperature onto the outer circumferential face of the insulated tip 202*a* of the insulating cover 202, at least a portion of the outer circumferential face of the insulated tip 202*a* may be discolored so as to be distinguishable from the insulating cover 202 surrounding the signs 50.

Although the signs 50 may be marked using an ink-jet marker, the laser radiated from the laser marker can mark the signs 50 with higher positional accuracy.

The number of the signs 50 may be any desired number such as 1, 2, 3, or more. The shape of the signs 50 may be any distinguishable shape including triangle, rectangle, star, rhombus, ellipse, and cross. The number and shape are not limited to those in embodiments.

Subsequently, a method of pressure-bonding the pressure-bonding section 30 of the female crimp terminal 10 to the wire tip 200*a* of the insulated wire 200, and its effects will be described with reference to FIGS. 3A to 3C.

First, the wire tip 200*a* of the insulated wire 200 is inserted into the pressure-bonding section 30 of the female crimp terminal 10 from the rear side toward the front side in the longitudinal direction X until substantially left halves of the signs 50 are hidden in the pressure-bonding section 30, and substantially right halves of the signs 50 are exposed from the pressure-bonding section 30 (see FIG. 3A).

Since the signs 50 are located at the distance of the internal length L of the pressure-bonding section 30 from the conductor tip face 201*aa* of the aluminum core wire 201, when the wire tip 200*a* of the insulated wire 200 is inserted into the pressure-bonding section 30 of the female crimp terminal 10 up to the signs 50, the conductor tip 201*a* of the aluminum core wire 201 contacts the sealing-side inner wall face of the pressure-bonding section 30 (see FIG. 3B).

That is, since the wire tip 200*a* of the insulated wire 200 is inserted by the length corresponding to the internal length L of the pressure-bonding section 30, the conductor tip 201*a* of the aluminum core wire 201 reaches a predetermined position in the pressure-bonding section 30.

By pressure-bonding the wire tip 200*a* of the insulated wire 200 to the wire pressure-bonding section 31 of the pressure-bonding section 30 with a pressure-bonding tool not shown in this state, as shown in FIGS. 2A and 2B, the pressure-bonding section 30 of the female crimp terminal 10 can be pressure-bonded to the wire tip 200*a* of the insulated wire 200 into a predetermined pressure-bonding state (see FIGS. 2A and 2B).

In inserting the wire tip 200*a* of the insulated wire 200 into the pressure-bonding section 30 of the female crimp terminal 10 up to the signs 50, when the signs 50 marked on the wire tip 200*a* are at least partially exposed from the pressure-bonding section 30 and partially hidden in the pressure-bonding section 30, one can reliably visually confirm that the conductor tip 201*a* of the aluminum core wire 201 is inserted to the predetermined position in the pressure-bonding section 30 from the outside of the pressure-bonding section 30 merely by visually checking the exposed portions of the signs 50.

When the entire signs 50 are exposed from the pressure-bonding section 30, one can reliably visually confirm that the wire tip 200*a* is insufficiently inserted into the pressure-bonding section 30 from the outside of the pressure-bonding section 30 merely by visually checking the exposed entire signs 50 (see FIG. 3C).

When the entire signs 50 are invisible behind the pressure-bonding section 30, the conductor tip 201*a* of the aluminum core wire 201 is excessively inserted into the pressure-bonding section 30.

Accordingly, when the wire tip 200*a* is inserted into the position where the opening-side rear end of the pressure-bonding section 30 coincides with the center of the signs 50, one can reliably visually confirm that the conductor tip 201*a* of the aluminum core wire 201 is inserted to the predetermined position in the pressure-bonding section 30 from the outside of the pressure-bonding section 30 merely by visually checking the signs 50 exposed from the pressure-bonding section 30.

As a result, a desired conducting state can be achieved by pressure-bonding the pressure-bonding section 30 to the wire tip 200*a* while the conductor tip 201*a* of the aluminum core wire 201 is inserted to the predetermined position in the pressure-bonding section 30.

The bilaterally-symmetric signs 50 having an easily-recognizable central portion (for example, ∞-shape) facilitate alignment of the center of the signs 50 with the opening-side rear end of the pressure-bonding section 30.

In the terminal connection structure thus configured in which the female crimp terminal 10 is pressure-bonded to the insulated wire 200, the front end of the pressure-bonding section 30 is completely sealed with the sealing portion 32 so as not to expose the aluminum core wire 201 of the insulated wire 200 to the outside, preventing water from entering into the pressure-bonding section 30 from the front end of the pressure-bonding section 30 in a post-pressure-bonding state.

This can also prevent galvanic corrosion caused by adhesion of water to the contact portion between the female crimp terminal 10 made of copper or a copper alloy as a nobler metal material and the aluminum core wire 201 made of aluminum or an aluminum alloy as a less noble metal.

Accordingly, corrosion of the surface of the aluminum core wire 201 and lowering of the conductivity between the female crimp terminal 10 and the aluminum core wire 201 can be prevented to maintain the water blocking state for a long time, resulting in high reliability.

That is, by pressure-bonding the conductor tip 201*a* of the aluminum core wire 201 to the pressure-bonding section 30 while being inserted to the predetermined position, so-called galvanic corrosion can be prevented while reducing weight as compared to the case of using an insulated wire including a conductor made of a copper-based material.

As a result, irrespective of the metal type forming the female crimp terminal 10 and the aluminum core wire 201 of the insulated wire 200, the terminal connection structure that ensures stable conductivity can be realized. However, as a matter of course, an insulated wire formed by bundling raw wires made of a copper-based material may be coated with the insulating cover 202.

Further, since the signs 50 marked on the wire tip 200*a* are discolored to be different from the insulating cover 202 around the signs 50, the signs 50 exposed from the pressure-bonding section 30 can be easily distinguished from the surroundings of the signs 50, one can reliably visually confirm that the conductor tip 201*a* of the aluminum core wire 201 is inserted to the predetermined position in the pressure-bonding section 30 from the outside of the pressure-bonding section 30, preventing false recognition.

Moreover, since the signs 50 are formed by changing some portions of the surface of the insulating cover 202 in color, when the wire tip 200*a* is inserted into the pressure-bonding section 30, the signs 50 are neither stripped off nor paled, keeping the visually-recognizable state for a long time.

The signs 50 may be directly viewed, or checked through a monitor by an image inspection, or an inspected image subjected to image processing may be visually checked.

Next, an example in which a pressure-bonding connection structural body 1*a* using the female crimp terminal 10 of the wire 1 with female crimp terminal thus configured and a pressure-bonding connection structural body 1*b* using the male crimp terminal (not shown) are attached to a pair of respective connector housings 300 will be described with reference to FIG. 9. The pressure-bonding connection structural body 1*a* is a connection structural body using the female crimp terminal 10, and the pressure-bonding connection structural body 1*b* is a connection structural body using the male crimp terminal.

The pressure-bonding connection structural bodies 1*a*, 1*b* can be attached to the respective connector housings 300 to constitute a female connector 3*a* and a male connector 3*b* that have reliable conductivity therebetween.

Although both the female connector 3*a* and the male connector 3*b* are connectors of a wire harness 301 (301*a*, 301*b*) in following description, one of them may be a connector of the wire harness and the other may be a connector of auxiliary equipment such as a board or a component.

This will be described in more detail. As shown in FIG. 9, the pressure-bonding connection structural bodies 1*a* formed using the female crimp terminal 10 of the wire 1 with female crimp terminal are attached to the female connector housing 300 to constitute the wire harness 301*a* provided with the female connector 3*a*.

The pressure-bonding connection structural bodies 1*b* formed using the male crimp terminal are attached to the male connector housings 300 to constitute the wire harness 301*b* provided with the male connector 3*b*.

The wire harness 301*a* can be connected to the wire harness 301*b* by engaging the female connector 3*a* and the male connector 3*b* thus configured with each other.

Since the pressure-bonding connection structural bodies 1*a*, 1*b* are attached to the connector housings 300, the wire harness 301 having reliable conductivity can be connected.

That is, the female crimp terminal 10 of the pressure-bonding connection structural bodies 1*a* and the male crimp terminal of the pressure-bonding connection structural bodies 1*b* have unexposed sealed configuration because the conductor tip 201*a* of the aluminum core wire 201 of the insulated wire 200 is integrally covered with the pressure-bonding section 30.

For this reason, even under exposure to outside air in the connector housings 300, electrical connection between the aluminum core wire 201 and the female crimp terminal 10 in the pressure-bonding section 30 can be maintained without any decrease in the conductivity due to galvanic corrosion, ensuring the connection state with reliable conductivity.

Figure 9:
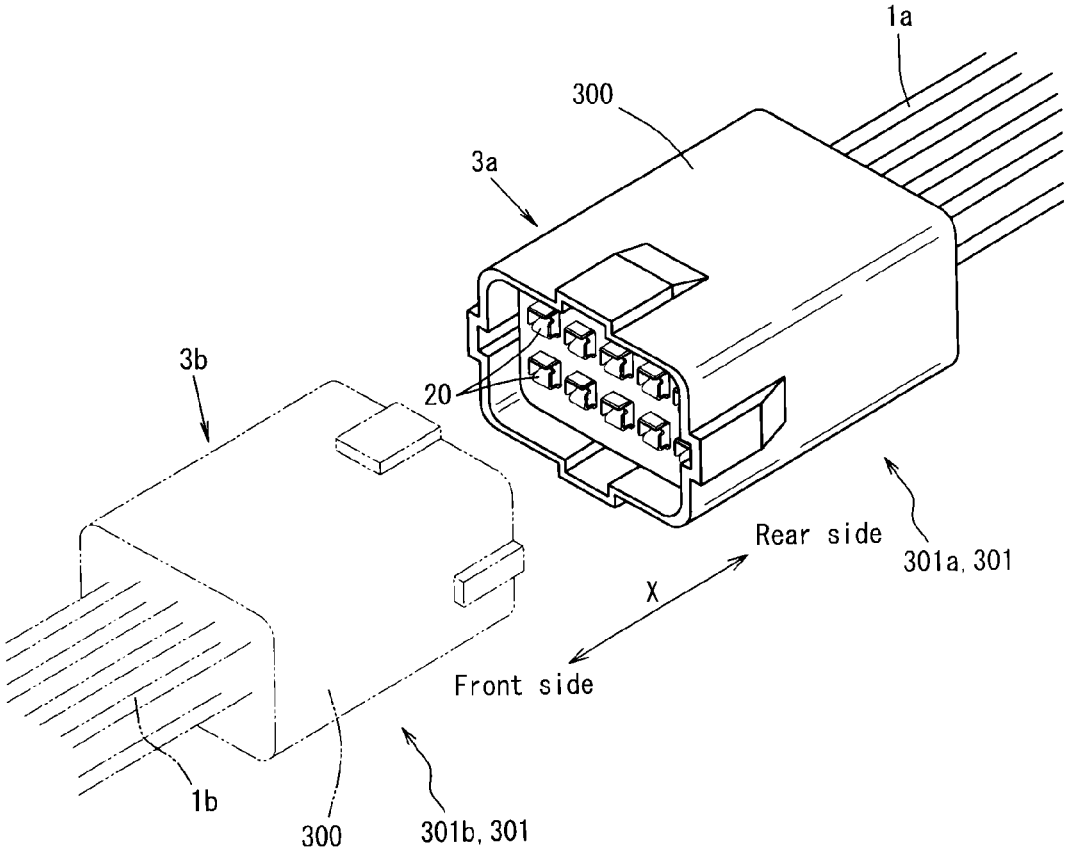
FIG. 9 is a perspective view illustrating a connector.

Although the plurality of pressure-bonding connection structural bodies 1*a*, 1*b* constitute the wire harness 301 in FIG. 9, one pressure-bonding connection structural body 1*a* and one pressure-bonding connection structural body 1*b* may be connected to the respective connector housings 300 to constitute the wire harness 301.

The same components in below-mentioned second to tenth embodiments as those in the first embodiment are given the same reference numerals, and detailed description thereof is omitted.

Second Embodiment

In the first embodiment, one row of the signs 50 are marked at a distance of the internal length L of the pressure-bonding section 30. However, as in the second embodiment shown in FIGS. 4A to 4C, plural rows of round signs 51, 52 may be marked at a position at a distance of the internal length L of the pressure-bonding section 30 and a position closer to the front end, respectively.

Figure 4A:
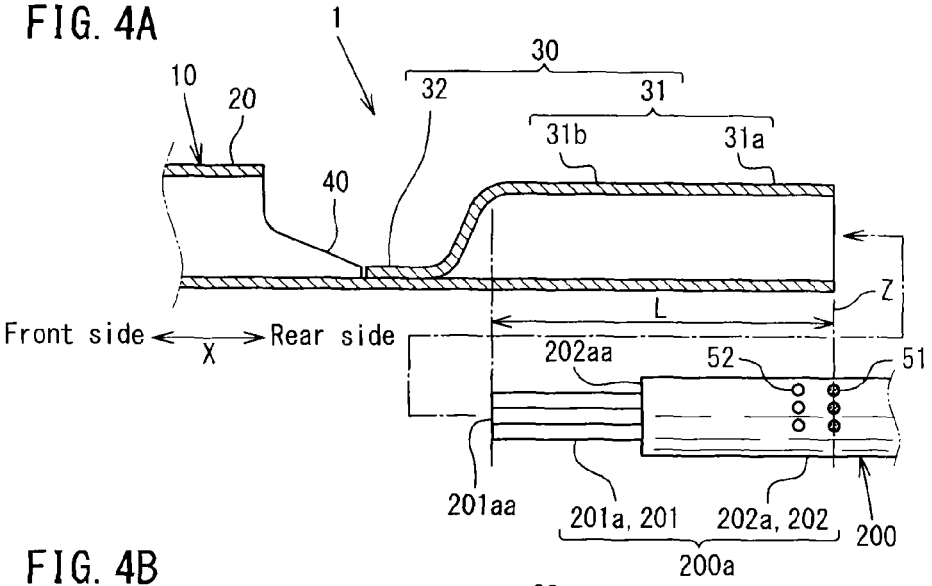
FIGS. 4A to 4C are views illustrating the procedure of inserting a wire tip in a second embodiment into the pressure-bonding section.
Figure 4B:
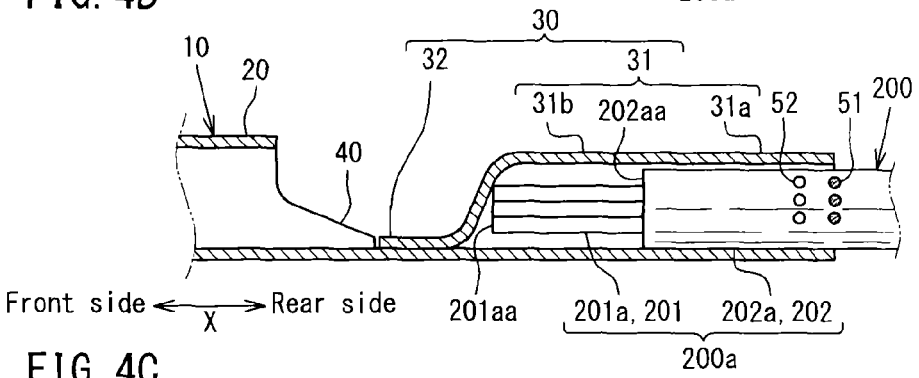
Figure 4C:
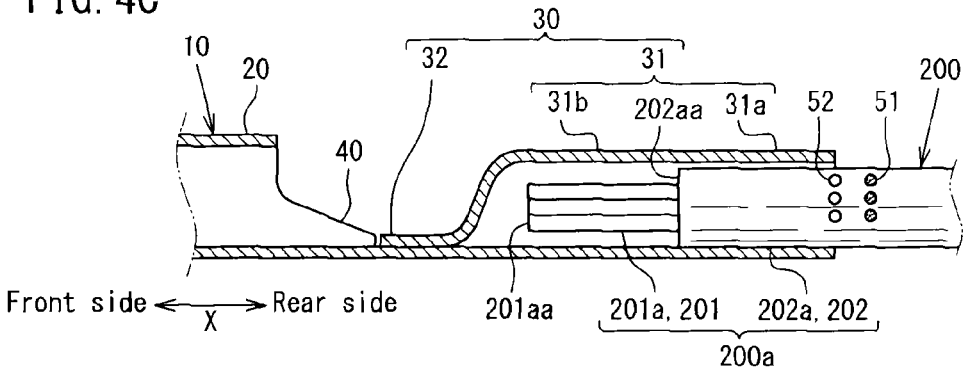

FIGS. 4A to 4C are views illustrating the procedure of inserting a wire tip 200*a* including the front and rear signs 51, 52 in the second embodiment into the pressure-bonding section 30. This will be described in more detail. FIG. 4A is a vertical sectional view showing the state immediately before the wire tip 200*a* is inserted into the pressure-bonding section 30, FIG. 4B is a vertical sectional view showing the state immediately after the wire tip 200*a* is inserted up to the signs 51 in the pressure-bonding section 30, and FIG. 4C is a vertical sectional view showing the state where the wire tip 200*a* is inserted up to the signs 52 in the pressure-bonding section 30.

This will be described in more detail. The three rear signs 51 are arranged at a distance of the internal length L of the pressure-bonding section 30 from the conductor tip face 201*aa* of the conductor tip 201*a* of the aluminum core wire 201 along the outer circumferential face at predetermined intervals in the circumferential direction.

The three front signs 52 are located in front of the rear signs 51, at a distance that is equal to or smaller than the range in which the conductor tip 201*a* of the aluminum core wire 201 is pressure-bonded to the conductor pressure-bonding section 31*b* of the pressure-bonding section 30 in the desired conductive state, from the signs 50 toward the front end of the conductor, along the outer circumferential face at predetermined intervals in the circumferential direction.

The signs 51, 52 are arranged in the longitudinal direction Y at a distance smaller than range in which the conductor tip 201*a* of the aluminum core wire 201 can be pressure-bonded to the conductor pressure-bonding section 31*b* of the pressure-bonding section 30 in the desired conductive state.

When the wire tip 200*a* of the insulated wire 200 on which the signs 51, 52 are marked is inserted up to the signs 51 in the pressure-bonding section 30 of the female crimp terminal 10 (see FIG. 4A), if the entire signs 51 are invisible behind the pressure-bonding section 30, the conductor tip 201*a* of the aluminum core wire 201 is excessively inserted into the pressure-bonding section 30.

When the wire tip 200*a* is inserted to the position where the opening-side rear end of the pressure-bonding section 30 coincides with the center of the signs 51, merely by visually checking the signs 51 exposed from the pressure-bonding section 30, one can reliably visually confirm that the conductor tip 201*a* of the aluminum core wire 201 is inserted to the predetermined position in the pressure-bonding section 30 from the outside of the pressure-bonding section 30 (see FIG. 4B).

Since the wire tip 200*a* of the insulated wire 200 is pressure-bonded to the pressure-bonding section 30 of the female crimp terminal 10 in this state, the substantially same actions and effects as in the above-described embodiment can be achieved.

When the signs 52 are at least partially exposed from the pressure-bonding section 30, merely by visually checking the exposed signs 52, one can reliably visually confirm that the wire tip 200*a* is insufficiently inserted into the pressure-bonding section 30 from the outside of the pressure-bonding section 30 (see FIG. 4C).

Accordingly, by arranging the front signs 51 and the rear signs 52 in combination, it can be determined whether or not the product is non-defective where the conductor tip 201*a* of the aluminum core wire 201 is inserted to the predetermined position in the pressure-bonding section 30 more reliably.

The signs 51, 52 may be changed in color to any distinguishable color (specifically, blue, red, or the like) from the insulating cover 202 surrounding the signs 51, 52. For example, by setting the signs 51 to blue and the signs 52 to red so as to easily distinguish the signs 51, 52 from the surroundings, the signs 51, 52 exposed from the pressure-bonding section 30 can be visually checked more reliably.

Third Embodiment

Figure 5A:
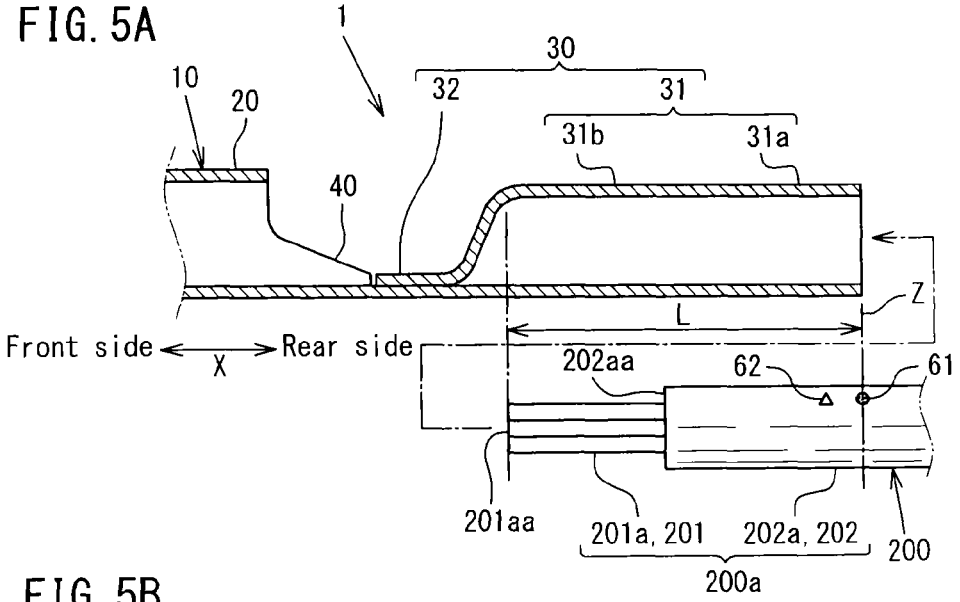
FIGS. 5A to 5C are views illustrating the procedure of inserting a wire tip in a third embodiment into the pressure-bonding section.
Figure 5B:
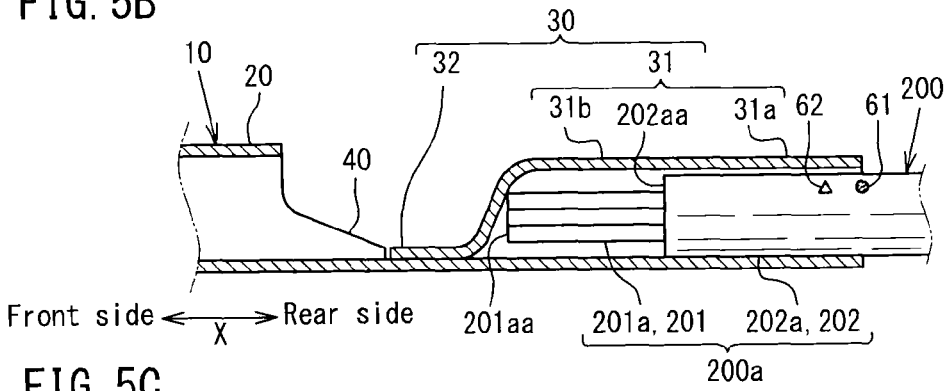
Figure 5C:
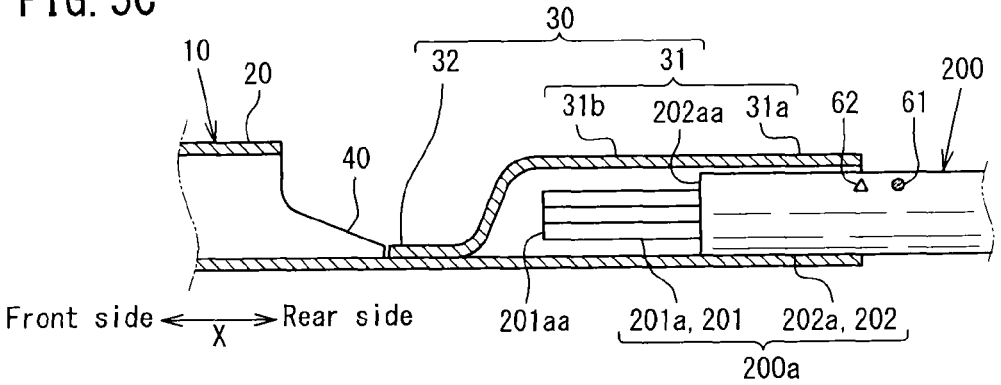

Although the signs 51, 52 of the same shape are marked by discoloring a part of the surface of the insulating cover 202 in the second embodiment, a round sign 61 and a triangular sign 62 that have different shapes as in the third embodiment in FIGS. 5A to 5C may be marked with a predetermined spacing in the longitudinal direction X.

FIGS. 5A to 5C are views illustrating the procedure of inserting a wire tip 200*a* including the round sign 61 and the triangular sign 62 that have different shapes in a third embodiment into the pressure-bonding section 30. This will be described in more detail. FIG. 5A is a vertical sectional view showing the state immediately before the wire tip 200*a* is inserted into the pressure-bonding section 30, FIG. 5B is a vertical sectional view showing the state immediately after the wire tip 200*a* is inserted up to the sign 61 in the pressure-bonding section 30, and FIG. 5C is a vertical sectional view showing the state where the wire tip 200*a* is inserted up to the sign 62 in the pressure-bonding section 30.

This will be described in more detail. The round sign 61 is marked at a distance of the internal length L of the pressure-bonding section 30 from the conductor tip face 201*aa* of the conductor tip 201*a* on the outer circumferential face.

The triangular sign 62 is located in front of the sign 61, and is marked at a distance that is equal to or smaller than the range in which the conductor tip 201*a* of the aluminum core wire 201 is pressure-bonded to the conductor pressure-bonding section 31*b* of the pressure-bonding section 30 in the desired conductive state, from the sign 62 toward the front end of the conductor, on the outer circumferential face.

Further, the signs 61, 62 are arranged in the longitudinal direction Y at a distance smaller than range in which the conductor tip 201*a* of the aluminum core wire 201 can be pressure-bonded to the conductor pressure-bonding section 31*b* of the pressure-bonding section 30 in the desired conductive state.

When the wire tip 200*a* of the insulated wire 200 on which the signs 61, 62 are marked is inserted up to the sign 61 in the pressure-bonding section 30 of the female crimp terminal 10 (see FIG. 5A), if the entire sign 61 is invisible behind the pressure-bonding section 30, the conductor tip 201*a* of the aluminum core wire 201 is excessively inserted into the pressure-bonding section 30.

When the wire tip 200*a* is inserted to the position where the opening-side rear end of the pressure-bonding section 30 coincides with the center of the sign 61, merely by visually checking the sign 61 exposed outside the pressure-bonding section 30, one can reliably visually confirm that the conductor tip 201*a* of the aluminum core wire 201 is inserted to the predetermined position in the pressure-bonding section 30 from the outside of the pressure-bonding section 30 (see FIG. 5B).

Since the wire tip 200*a* of the insulated wire 200 is pressure-bonded to the pressure-bonding section 30 of the female crimp terminal 10 in this state, the substantially same actions and effects as in the above-described embodiments can be achieved.

When the sign 62 is at least partially exposed from the pressure-bonding section 30, merely by visually checking the exposed portion of the sign 62, one can reliably visually confirm that the wire tip 200*a* is insufficiently inserted into the pressure-bonding section 30 from the outside of the pressure-bonding section 30 (see FIG. 5C).

Accordingly, by arranging the front sign 61 and the rear sign 62 in combination, it can be determined whether or not the product is non-defective where the conductor tip 201*a* of the aluminum core wire 201 is inserted to the predetermined position in the pressure-bonding section 30 more reliably.

The signs 61, 62 of different shapes facilitate discrimination between the signs and between the sign and its surroundings, resulting in that the sign 61 exposed from the pressure-bonding section 30 can be visually checked more reliably.

The signs 61, 62 may be changed in color to any distinguishable color (specifically, green, red, or the like) from the insulating cover 202 surrounding the signs 61, 62. For example, by setting the sign 61 to red and the sign 62 to green, the signs 61, 62 have different colors and shapes and discrimination between the signs 61, 62 and between the sign and its surroundings is further facilitated, resulting in that the signs 61, 62 exposed from the pressure-bonding section 30 can be visually checked more reliably.

Although the signs 50 to 52, 61, and 62 are marked by discoloring some portions of the surface of the insulating cover 202 in the first to third embodiments, the signs 50 to 52 may be formed by adding a material that is different in color from the surroundings of the signs 50 to 52 to at least some portions of the outer circumferential face of the insulating cover 202.

In forming the signs 50 to 52, an ink of distinguishable color (specifically, red, green, or the like) from the surroundings of the signs 50 to 52 is printed or applied with a marker or an ink-jet marker not shown according to screen printing or offset printing.

As a result, since the signs 50 to 52 exposed from the pressure-bonding section 30 can be easily distinguished from the surroundings of the signs 50 to 52, one can visually confirm that the conductor tip 201*a* of the aluminum core wire 201 is inserted to the predetermined position in the pressure-bonding section 30 from the outside of the pressure-bonding section 30 more surely, preventing false recognition.

The signs 50 to 52, 61, and 62 may be made of a material of another color which is kneaded into the insulating cover 202, and in this case, since the signs 50 to 52 exposed from the pressure-bonding section 30 can be easily distinguished from the surroundings of the signs 50 to 52, one can visually confirm that the conductor tip 201*a* of the aluminum core wire 201 is inserted to the predetermined position in the pressure-bonding section 30, from the outside of the pressure-bonding section 30 more surely.

Moreover, since the signs 50 to 52 are integrally kneaded into the insulating cover 202, when the wire tip 200*a* is inserted into the pressure-bonding section 30, the signs 50 to 52 are neither stripped off nor paled, keeping the visually-recognizable state for a long time.

Fourth Embodiment

Figure 6A:
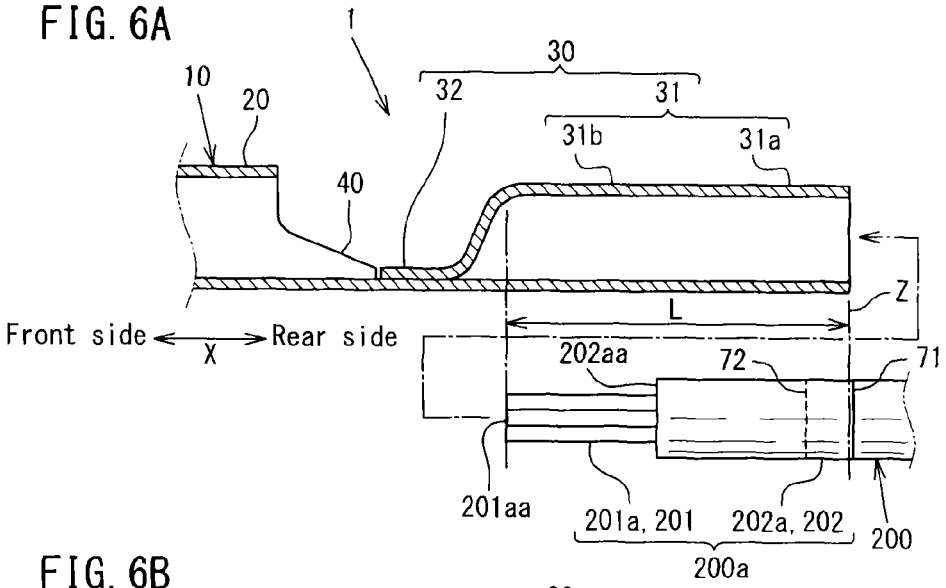
FIGS. 6A to 6C are views illustrating the procedure of inserting a wire tip in a fourth embodiment into the pressure-bonding section.
Figure 6B:
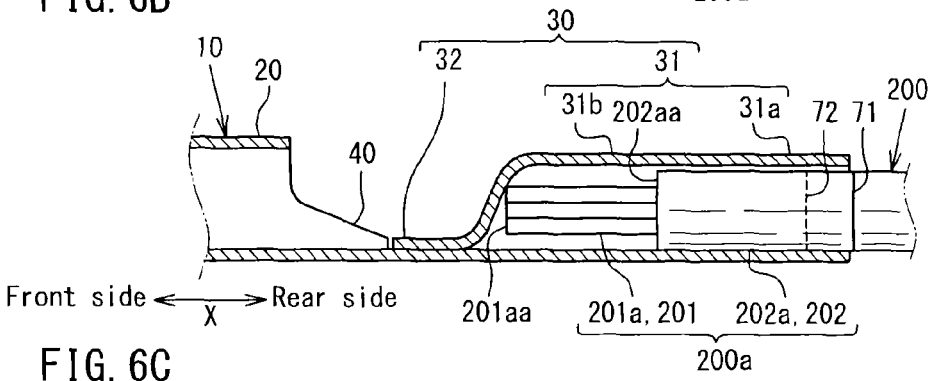
Figure 6C:
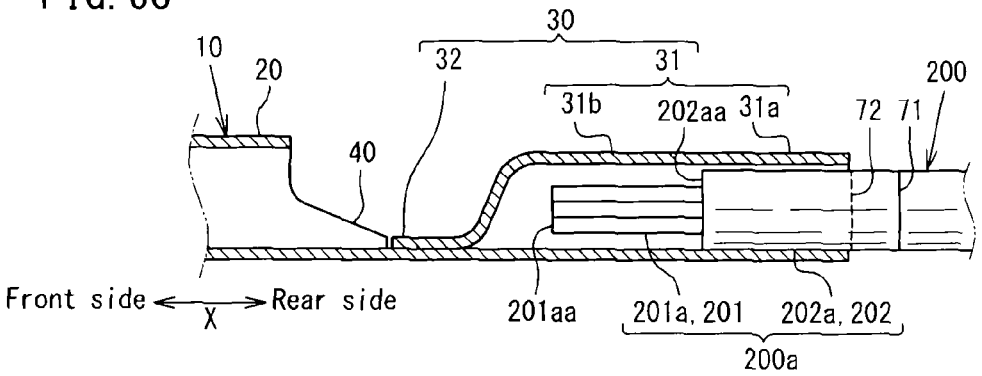

Although the signs 50 to 52 of the same shape, or the signs 61, 62 of different shapes are locally marked on the surface of the insulating cover 202 in the first to third embodiments, a linear sign 71 and a dashed sign 72 that have different line types may be marked with a predetermined spacing in the longitudinal direction X by printing or application as in a fourth embodiment shown in FIGS. 6A to 6C.

FIGS. 6A to 6C are views illustrating the procedure of inserting a wire tip 200*a* including the linear sign 71 and the dashed sign 72 in the fourth embodiment into the pressure-bonding section 30. This will be described in more detail. FIG. 6A is a vertical sectional view showing the state immediately before the wire tip 200*a* is inserted into the pressure-bonding section 30, FIG. 6B is a vertical sectional view showing the state immediately after the wire tip 200*a* is inserted up to the sign 71 in the pressure-bonding section 30, and FIG. 6C is a vertical sectional view showing the state where the wire tip 200*a* is inserted up to the sign 72 of the pressure-bonding section 30.

This will be described in more detail. The linear sign 71 is marked at a distance of the internal length L of the pressure-bonding section 30 from the conductor tip face 201*aa* of the conductor tip 201*a* on the outer circumferential face in the circumferential direction.

The dashed sign 72 is located in front of the sign 71, and is arranged at a distance that is equal to or smaller than the range in which the conductor tip 201*a* of the aluminum core wire 201 is pressure-bonded to the conductor pressure-bonding section 31*b* of the pressure-bonding section 30 in the desired conductive state, from the sign 71 toward the front end of the conductor, along the outer circumferential face of the insulating cover 202 in the circumferential direction.

The signs 71, 72 are arranged in the longitudinal direction Y at a distance smaller than range in which the conductor tip 201*a* of the aluminum core wire 201 can be pressure-bonded to the conductor pressure-bonding section 31*b* of the pressure-bonding section 30 in the desired conductive state.

The position or spacing of the signs 71, 72 may be set based on the conductor tip face 201*aa* of the conductor tip 201*a* and the insulated tip face 202*aa* of the insulated tip 202*a*.

The signs 71, 72 are marked by printing or applying an ink of distinguishable color (specifically, red, green, or the like) from the insulating cover 202 surrounding the signs 71, 72 by use of a marker or an ink-jet marker not shown according to screen printing, offset printing, or the like. For example, by setting the sign 71 to red and the sign 72 to green, the signs 71, 72 having different line types and colors can be easily distinguished.

When the wire tip 200*a* of the insulated wire 200 on which the signs 71, 72 are marked is inserted up to the sign 71 in the pressure-bonding section 30 of the female crimp terminal 10 (see FIG. 6A), if the entire sign 71 is invisible behind the pressure-bonding section 30, the conductor tip 201*a* of the aluminum core wire 201 is excessively inserted into the pressure-bonding section 30.

When the wire tip 200*a* is inserted to the position where the opening-side rear end of the pressure-bonding section 30 substantially coincides with the sign 71, merely by visually checking the sign 71 exposed from the pressure-bonding section 30, one can reliably visually confirm that the conductor tip 201*a* of the aluminum core wire 201 is inserted to the predetermined position in the pressure-bonding section 30 from the outside of the pressure-bonding section 30 (see FIG. 6B).

Since the pressure-bonding section 30 of the female crimp terminal 10 is pressure-bonded to the wire tip 200*a* of the insulated wire 200 in this state, the substantially same actions and effects as in the above-described embodiments can be achieved.

When the sign 72 is exposed from the pressure-bonding section 30, merely by visually checking the exposed sign 72, one can reliably ensure that the wire tip 200*a* is insufficiently inserted into the pressure-bonding section 30 from the outside of the pressure-bonding section 30 (see FIG. 6C).

Accordingly, by arranging the sign 71 and the sign 72 in combination, it is possible to determine whether or not the product is non-defective where the conductor tip 201*a* of the aluminum core wire 201 is inserted to the predetermined position in the pressure-bonding section 30 more reliably.

The signs 71, 72 of different line types and colors further facilitate discrimination between the signs 71, 72 and between the sign and its surroundings as compared to the case of discrimination based on only the line type, resulting in that the signs 71, 72 exposed from the pressure-bonding section 30 can be visually checked more reliably.

Since the dashed sign 72 is marked along the outer circumferential face of the insulating cover 202 in the circumferential direction, as compared to the case where the sign provided in the longitudinal direction Y serves as a passage for water to lower the water-blocking performance, a higher water-blocking performance in the pressure-bonding state can be obtained.

Fifth Embodiment

Figure 7A:
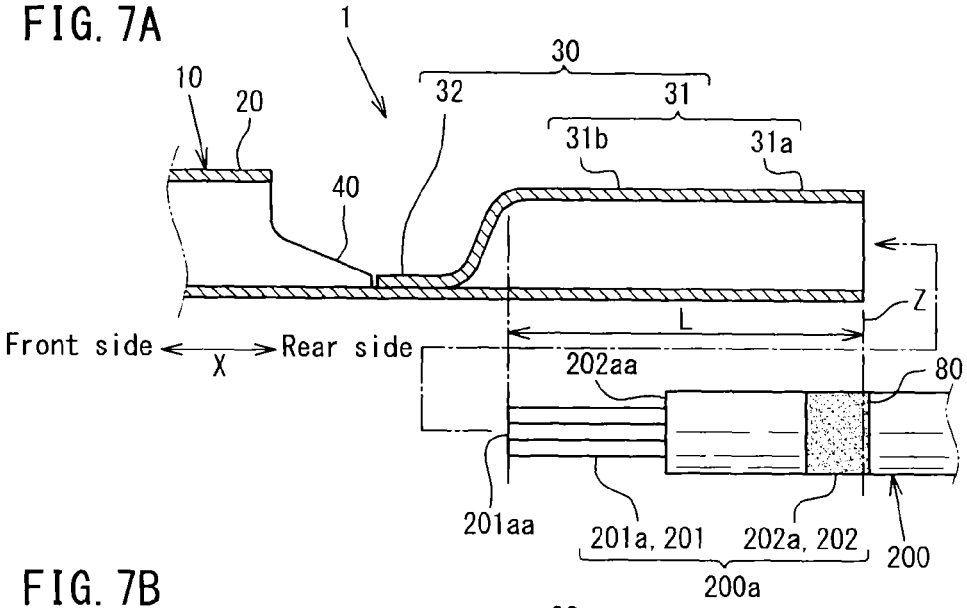
FIGS. 7A to 7C are views illustrating the procedure of inserting a wire tip in a fifth embodiment into the pressure-bonding section.
Figure 7B:
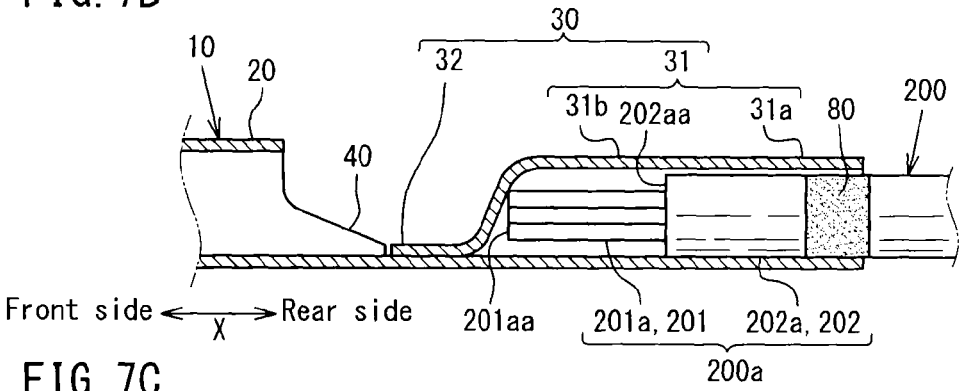
Figure 7C:
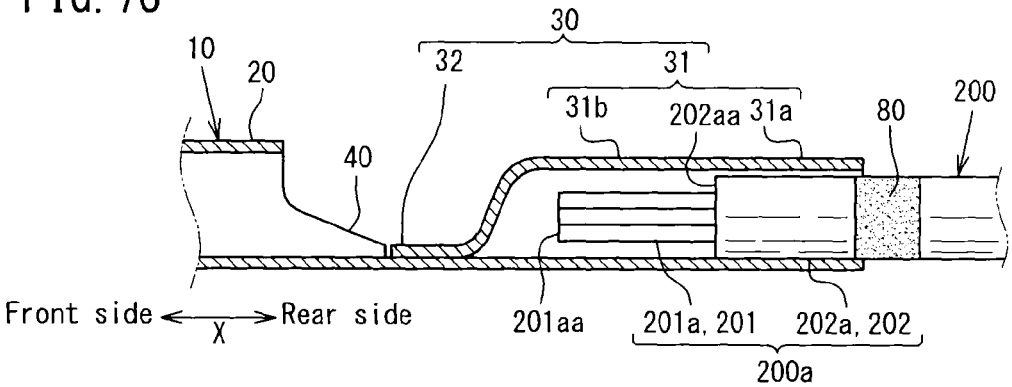

Although the linear sign 71 and the dashed sign 72 that have different line types are marked on the outer circumferential face of the insulating cover 202 in the fourth embodiment, a wide sign 80 may be formed on the outer circumferential face of the insulating cover 202 in the circumferential direction as in a fifth embodiment shown in FIGS. 7A to 7C.

FIGS. 7A to 7C are views illustrating the procedure of inserting a wire tip 200*a* including the wide sign 80 in the fifth embodiment into the pressure-bonding section 30. This will be described in more detail. FIG. 7A is a vertical sectional view showing the state immediately before the wire tip 200*a* is inserted into the pressure-bonding section 30, FIG. 7B is a vertical sectional view showing the state immediately after the wire tip 200*a* is inserted to the pressure-bonding section 30 with the rear end of the sign 80 exposed, and FIG. 7C is a vertical sectional view showing the state where the wire tip 200*a* is inserted into the pressure-bonding section 30 until the front end of the sign 80 is hidden.

This will be described in more detail. The wide sign 80 is wide in the longitudinal direction X of the insulated wire 200. A width of the sign 80 in the longitudinal direction X is set to correspond to the range in which the conductor tip 201*a* of the aluminum core wire 201 is pressure-bonded to the conductor pressure-bonding section 31*b* of the pressure-bonding section 30 in the desired conductive state.

That is, the rear end of the sign 80 is formed on the outer circumferential face of the insulating cover 202 which includes the position located at a distance of the internal length L of the pressure-bonding section 30 from the conductor tip face 201*aa* of the conductor tip 201*a*.

The front end of the sign 80 is located in front of the rear end of the sign 80, and is formed at a distance corresponding to the range in which the conductor tip 201*a* of the aluminum core wire 201 is pressure-bonded to the conductor pressure-bonding section 31*b* of the pressure-bonding section 30 in the desired conductive state, from the rear end toward the front end of the conductor, on the outer circumferential face of the insulating cover 202.

The sign 80 is made of a more flexible material than the insulating cover 202, such as a synthetic resin, and is located along the outer circumferential face of the insulated tip 202*a* of the insulating cover 202 in the circumferential direction so as to cover the outer circumferential face.

When the wire tip 200*a* of the insulated wire 200 on which the sign 80 is formed is inserted up to the rear end of the sign 80 in the pressure-bonding section 30 of the female crimp terminal 10 (see FIG. 7A), if the rear end of the sign 80 is invisible behind the pressure-bonding section 30, the conductor tip 201*a* of the aluminum core wire 201 is excessively inserted into the pressure-bonding section 30.

When the wire tip 200*a* is inserted to the position where the opening-side rear end of the pressure-bonding section 30 substantially coincides with the rear end of the sign 80, merely by visually checking the sign 80 exposed from the pressure-bonding section 30, one can reliably visually confirm that the conductor tip 201*a* of the aluminum core wire 201 is inserted to the predetermined position in the pressure-bonding section 30 from the outside of the pressure-bonding section 30 (see FIG. 7B).

Since the pressure-bonding section 30 of the female crimp terminal 10 is pressure-bonded to the wire tip 200*a* of the insulated wire 200 in this state, the substantially same actions and effects as in the above-described embodiments can be achieved.

If the front end of the sign 80 is exposed from the pressure-bonding section 30, merely by visually checking the exposed sign 80, one can reliably visually confirm that the wire tip 200*a* is insufficiently inserted into the pressure-bonding section 30 from the outside of the pressure-bonding section 30 (see FIG. 7C).

Accordingly, by inserting the wire tip such that the front end of the sign 80 is invisible behind the pressure-bonding section 30, and the rear end of the sign 80 is exposed from the pressure-bonding section 30, it is possible to determine whether or not the product is non-defective where the conductor tip 201*a* of the aluminum core wire 201 is inserted to the predetermined position in the pressure-bonding section 30 more reliably.

Further, when the wire tip 200*a* is pressure-bonded to the pressure-bonding section 30, the highly flexible sign 80 has a high conformance to shape variation and thus, is easily deformed into the pressure-bonded shape, such that opposed faces of the wire tip 200*a* and the pressure-bonding section 30 are in close contact with each other to block water.

As a result, water can be prevented from entering into the pressure-bonding section 30 to ensure a good water-blocking performance.

Since the sign 80 that is wide in the longitudinal direction X of the insulated wire 200 is formed in the circumferential direction on the outer circumferential face of the insulating cover 202, as compared to the case where the sign provided in the longitudinal direction Y serves as a passage for water to lower the water-blocking performance, a higher water-blocking performance in the pressure-bonding state can be obtained.

Sixth Embodiment

Figure 8A:
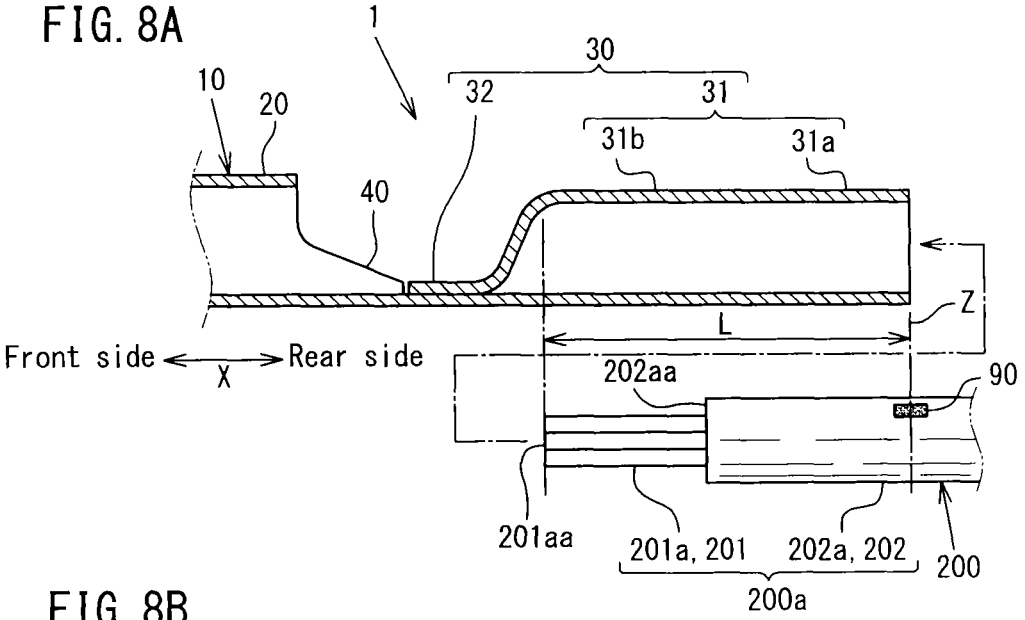
FIGS. 8A to 8C are views illustrating the procedure of inserting a wire tip in a sixth embodiment into the pressure-bonding section.
Figure 8B:
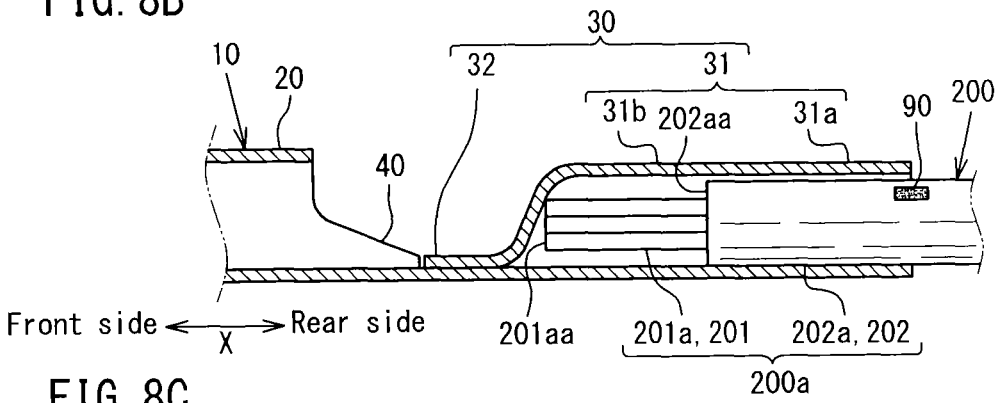
Figure 8C:
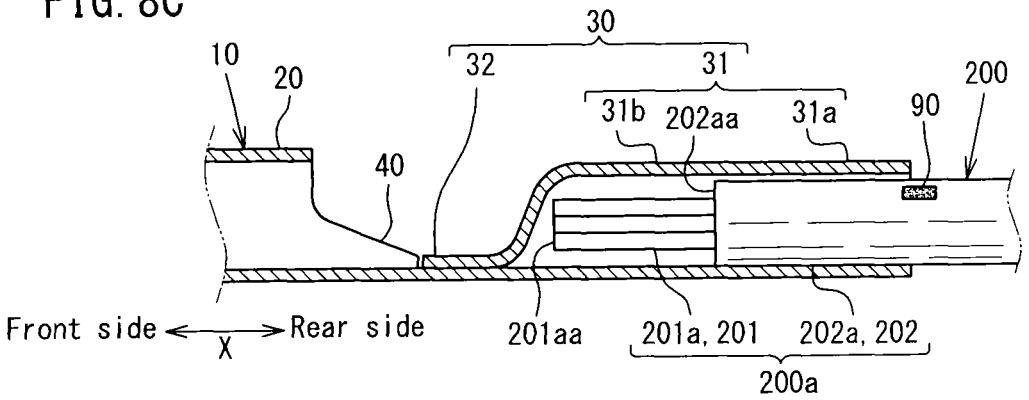

Although the wide sign 80 is attached to the outer circumferential face of the insulating cover 202 in the fifth embodiment, a band-like sign 90 may be marked on the outer circumferential face of the insulating cover 202 in the longitudinal direction X as in a sixth embodiment shown in FIGS. 8A to 8C.

FIGS. 8A to 8C are views illustrating the procedure of inserting a wire tip 200*a* including the band-like sign 90 in the sixth embodiment into the pressure-bonding section 30. This will be described in more detail. FIG. 8A is a vertical sectional view showing the state immediately before the wire tip 200*a* is inserted into the pressure-bonding section 30, FIG. 8B is a vertical sectional view showing the state immediately after the wire tip 200*a* is inserted up to the center of the sign 90 in the pressure-bonding section 30, and FIG. 8C is a vertical sectional view showing the state where the wire tip 200*a* is inserted into the pressure-bonding section 30 until the front end of the sign 90 is hidden.

This will be described in more detail. The band-like sign 90 has a length that is equal to or smaller than the range in which the conductor tip 201*a* of the aluminum core wire 201 is pressure-bonded to the conductor pressure-bonding section 31*b* of the pressure-bonding section 30 in the desired conductive state, at a distance of the internal length L of the pressure-bonding section 30 from the conductor tip face 201*aa* of the conductor tip 201*a* toward the front end of the conductor.

The sign 90 is marked by changing the color of at least a portion of the outer circumferential face of the insulated tip 202*a* to a distinguishable color from the insulating cover 202 surrounding the sign 90, for example, using a heated iron.

When the wire tip 200*a* of the insulated wire 200 on which the sign 90 is marked is inserted to the position where the opening-side rear end of the pressure-bonding section 30 in the female crimp terminal 10 substantially coincides with the center of the sign 90, merely by visually checking the sign 90 exposed from the pressure-bonding section 30, one can reliably visually confirm that the conductor tip 201*a* of the aluminum core wire 201 is inserted to the predetermined position of the conductor pressure-bonding section 31*b* of the pressure-bonding section 30 from the outside of the pressure-bonding section 30 (see FIGS. 8A and 8B).

Since the wire tip 200*a* of the insulated wire 200 is pressure-bonded to the pressure-bonding section 30 of the female crimp terminal 10 in this state, the substantially same actions and effects as in the above-described embodiments can be achieved.

If the front end of the sign 90 is exposed from the pressure-bonding section 30, merely by visually checking the exposed sign 90, one can reliably visually confirm that the wire tip 200*a* is insufficiently inserted into the pressure-bonding section 30 from the outside of the pressure-bonding section 30 (see FIG. 8C).

If the rear end of the sign 90 is invisible behind the pressure-bonding section 30, the conductor tip 201*a* of the aluminum core wire 201 is excessively inserted into the conductor pressure-bonding section 31*b* of the pressure-bonding section 30.

Accordingly, by inserting the wire tip such that the front end of the sign 90 is invisible behind the pressure-bonding section 30, and the rear end of the sign 90 is exposed from the pressure-bonding section 30, it is possible to determine whether or not the product is non-defective where the conductor tip 201*a* of the aluminum core wire 201 is inserted to the predetermined position in the pressure-bonding section 30 more reliably.

When the sign 90 is made of a thick but flexible material, the sign 90 is deformed conforming to the pressure-bonded shape of the pressure-bonding section in pressure-bonding of the pressure-bonding section 30 to the wire tip 200*a*, preventing lowering of the water-blocking performance of the pressure-bonding section.

The sign 80 in the fifth embodiment and the sign 90 in the sixth embodiment may be changed from the insulating cover 202 surrounding the signs 80, 90 in color, and in this case, the signs 80, 90 exposed from the pressure-bonding section 30 can be easily distinguished from the surroundings of the signs 80, 90, achieving more reliable visual check of the signs 80, 90 exposed from the pressure-bonding section 30.

The signs 80, 90 may be formed by discoloring (including transforming) the surface of the insulating cover 202, making printing on the surface, or kneading a material that is different from the insulating cover 202 in color into the cover.

Seventh Embodiment

In the second embodiment, the signs 51, 52 are arranged at a distance smaller than range in which the conductor tip 201*a* of the aluminum core wire 201 can be pressure-bonded to the conductor pressure-bonding section 31*b* of the pressure-bonding section 30 in the desired conductive state. However, as in a seventh embodiment shown in FIGS. 10A and 10B, round signs 51X, 52X may be disposed with a spacing corresponding to the range in which serrations of the pressure-bonding section 30, which correspond to the conductor tip 201*a* of the aluminum core wire 201, are wholly pressure-bonded.

Figure 10A:
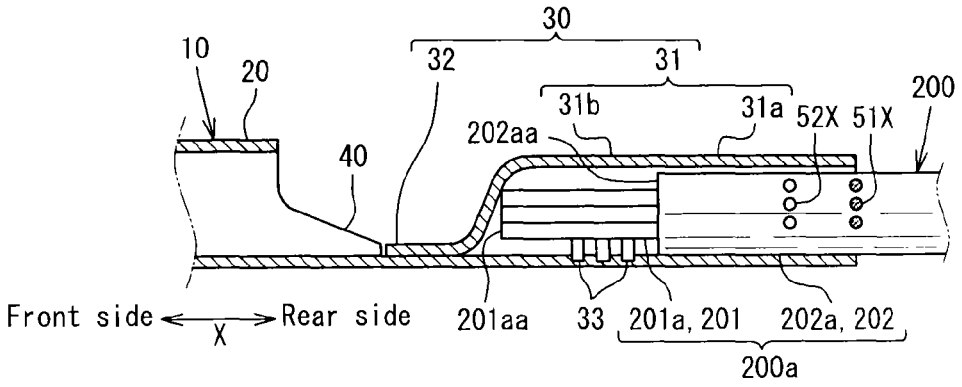
FIGS. 10A and 10B are views illustrating the procedure of inserting a wire tip in a seventh embodiment into the pressure-bonding section.
Figure 10B:
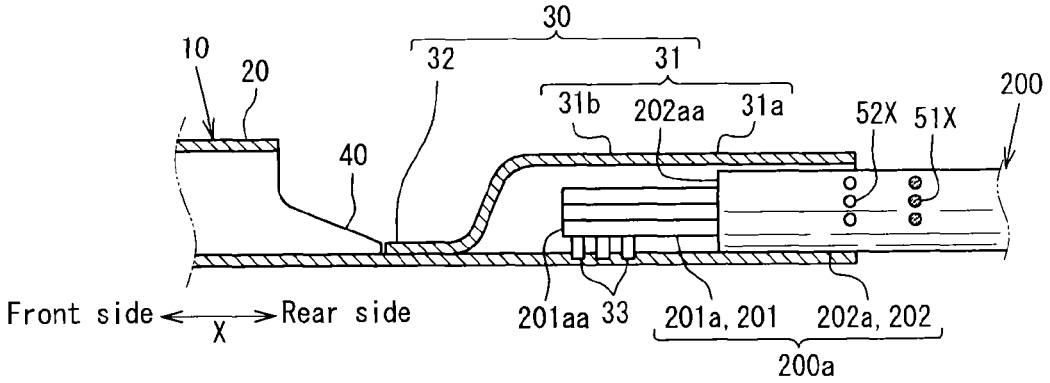

FIGS. 10A and 10B are views illustrating the procedure of inserting a wire tip 200*a* including the signs 51X, 52X in the seventh embodiment into the pressure-bonding section 30. This will be described in more detail. FIG. 10A is a vertical sectional view showing the state immediately after the wire tip 200*a* is inserted up to the center of the signs 51X in the pressure-bonding section 30, and FIG. 10B is a vertical sectional view showing the state where the wire tip 200*a* is inserted into the pressure-bonding section 30 until the substantially entire signs 52X are hidden.

Three serrations 33 as grooves that extending in the width direction Y and engage with the aluminum core wire 201 in the pressure-bonding state are formed in the inner circumferential face of the conductor pressure-bonding section 31*b* of the pressure-bonding section 30 at predetermined intervals in the longitudinal direction X.

The serrations 33 are shaped like grooves extending from the inner central bottom face to both inner side faces of the conductor pressure-bonding section 31*b* in the width direction Y.

The signs 51X are formed on the outer circumferential face of the insulating cover 202 that includes a position at a distance corresponding to the insertion amount in which the conductor tip 201*a* is pressure-bonded so as to contact the entire serrations of the pressure-bonding section 30, from the conductor tip face 201*aa* of the conductor tip 201*a* of the aluminum core wire 201.

The signs 52X are arranged at a distance corresponding to the range in which the conductor tip 201*a* is pressure-bonded so as to contact the entire serrations including the serrations 33 of the pressure-bonding section 30, from the signs 51X toward the front end of the conductor.

That is, the signs 51X, 52X are arranged in the longitudinal direction X at a distance corresponding to the range in which the conductor tip 201*a* of the aluminum core wire 201 can be pressure-bonded to the conductor pressure-bonding section 31*b* of the pressure-bonding section 30 in the desired conductive state.

When the wire tip 200*a* of the insulated wire 200 on which the signs 51X, 52X are marked is inserted to the position where the opening-side rear end of the pressure-bonding section 30 in the female crimp terminal 10 coincides with the center of the signs 51X, merely by visually checking the signs 51X exposed from the pressure-bonding section 30, one can visually confirm that the conductor tip 201*a* of the aluminum core wire 201 is inserted to the predetermined position in the pressure-bonding section 30, and that the substantially entire range in which the serrations of the pressure-bonding section 30 can be pressure-bonded falls within the conductor tip 201*a*, from the outside of the pressure-bonding section 30 (see FIG. 10A).

When the wire tip 200*a* of the insulated wire 200 is pressure-bonded to the pressure-bonding section 30 of the female crimp terminal 10 in this state, the conductor tip 201*a* pressure-bonded to the bottom face of the conductor pressure-bonding section 31*b* engages with the concave serrations 33 and is deformed, resulting in that the conductor tip 201*a* contacts the whole serrations of the pressure-bonding section 30.

This increases the contact area to lead to electrical connection having a small electrical resistance, thereby achieving the substantially same actions and effects as in the above-described embodiments.

When the entire signs 52X are invisible behind the pressure-bonding section 30 and the entire signs 51X are exposed from the pressure-bonding section 30, merely by visually checking the exposed signs 51X, one can visually confirm that at least the front end of the conductor tip 201*a* is inserted such that the serrations of the pressure-bonding section 30 can be pressure-bonded, from the outside of the pressure-bonding section 30, and the conductor tip 201*a* can be pressure-bonded so as to contact the whole serrations of the pressure-bonding section 30 (see FIG. 10B).

As described above, by arranging the signs 51X and the signs 52X in combination, it is possible to determine whether or not the product is non-defective where the conductor tip 201*a* is inserted to the predetermined position where the serrations of the pressure-bonding section 30 are pressure-bonded more reliably.

The configuration in the seventh embodiment can be also applied to the signs 51, 52 in the second embodiment, the signs 61, 62 in the third embodiment, and the signs 71, 72 in the fourth embodiment.

Eighth Embodiment

Figure 11A:
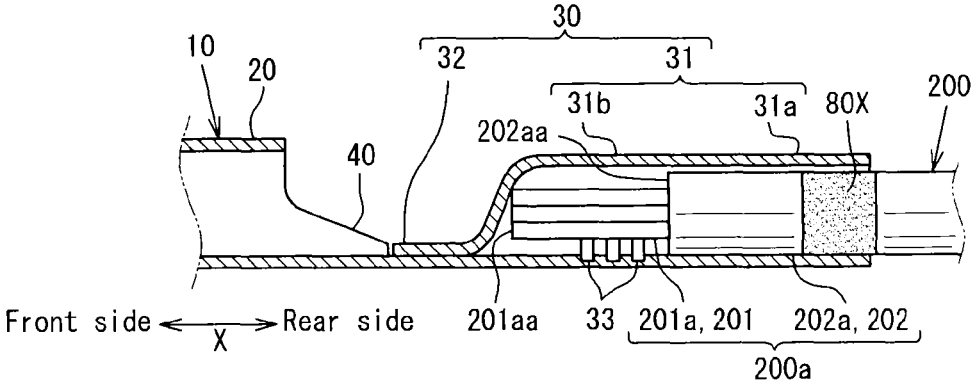
FIGS. 11A and 11B are views illustrating the procedure of inserting a wire tip in an eighth embodiment into the pressure-bonding section.
Figure 11B:
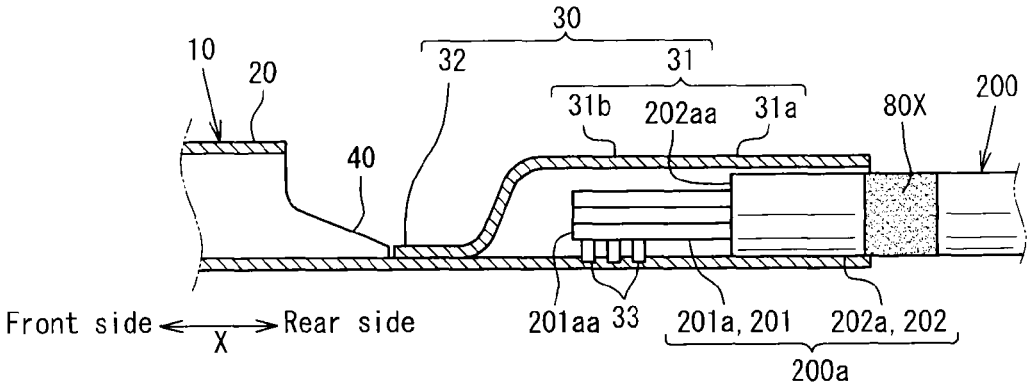

Although the sign 80 is formed to have the width corresponding to the range in which the conductor tip 201*a* of the aluminum core wire 201 is pressure-bonded to the conductor pressure-bonding section 31*b* of the pressure-bonding section 30 in the desired conductive state in the fifth embodiment, the sign 80X having a width corresponding to the range in which the conductor tip 201*a* is pressure-bonded so as to contact the whole serrations of the pressure-bonding section 30 may be formed as in an eighth embodiment shown in FIGS. 11A and 11B.

FIGS. 11A and 11B are views illustrating the procedure of inserting a wire tip 200*a* including the wide sign 80X in the eighth embodiment into the pressure-bonding section 30. This will be described in more detail. FIG. 11A is a vertical sectional view showing the state immediately after the wire tip 200*a* is inserted into the pressure-bonding section 30 with the rear end of the sign 80X exposed, and FIG. 11B is a vertical sectional view showing the state where the wire tip 200*a* is inserted into the pressure-bonding section 30 until the front end of the sign 80X is hidden.

The sign 80X is wide in the longitudinal direction X of the insulated wire 200. A width of the sign 80X in the longitudinal direction X is set to a width corresponding to the range in which the conductor tip 201*a* of the aluminum core wire 201 is pressure-bonded to the conductor pressure-bonding section 31*b* of the pressure-bonding section 30 in the desired conductive state.

That is, the sign 80X is formed on the outer circumferential face of the insulating cover 202 that includes a position at a distance corresponding to the insertion amount in which the conductor tip 201*a* is pressure-bonded so as to contact the entire serrations of the pressure-bonding section 30, from the conductor tip face 201*aa* of the conductor tip 201*a*.

The front end of the sign 80X is located in front of the rear end of the sign 80X, and is formed on the outer circumferential face at a distance corresponding to the range in which the conductor tip 201*a* contacts the whole serrations including the serrations 33 of the pressure-bonding section 30, from the rear end toward the front end of the conductor.

When the wire tip 200*a* of the insulated wire 200 on which the sign 80X is formed is inserted to the position where the opening-side rear end of the pressure-bonding section 30 in the female crimp terminal 10 substantially coincides with the rear end of the sign 80X, merely by visually checking the sign 80X exposed from the pressure-bonding section 30, one can visually confirm that the conductor tip 201*a* of the aluminum core wire 201 is inserted to the predetermined position in the pressure-bonding section 30, and that the entire length of the conductor tip 201*a* falls within the range in which the conductor tip can be pressure-bonded to the conductor pressure-bonding section 31*b* of the pressure-bonding section 30 from the outside of the pressure-bonding section 30 (see FIG. 11A).

When the wire tip 200*a* of the insulated wire 200 is pressure-bonded to the pressure-bonding section 30 of the female crimp terminal 10 in this state, the conductor tip 201*a* can contact the whole serrations of the pressure-bonding section 30.

This increases the contact area to lead to electrical connection having a small electrical resistance, thereby achieving the substantially same actions and effects as in the above-described embodiments.

When the front end of the sign 80X is invisible behind the pressure-bonding section 30, and the rear end of the sign 80X is exposed from the pressure-bonding section 30, merely by visually checking the exposed sign 80X, one can visually confirm that at least the front end of the conductor tip 201*a* is inserted such that the serrations of the pressure-bonding section 30 can be pressure-bonded, from the outside of the pressure-bonding section 30, and the conductor tip 201*a* can contact the entire serrations of the pressure-bonding section 30 (see FIG. 11B).

As described above, by inserting the conductor tip until the front end of the sign 80X is invisible behind the pressure-bonding section 30 and the rear end of the sign 80X is exposed from the pressure-bonding section 30, one can determine whether or not the product is non-defective where the conductor tip 201*a* is inserted to the predetermined position to be pressure-bonded to the serrations of the pressure-bonding section 30 more reliably.

Since the sign 80X that is wide in the longitudinal direction X of the insulated wire 200 is formed in the circumferential direction on the outer circumferential face of the insulating cover 202, as compared to the case where the sign provided in the longitudinal direction Y serves as a passage for water to lower the water-blocking performance, a higher water-blocking performance in the pressure-bonding state can be obtained.

Ninth Embodiment

Figure 12A:
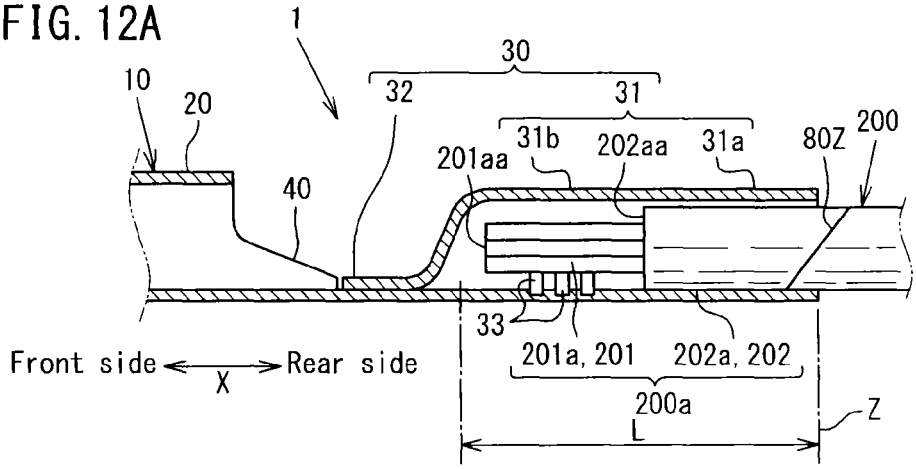
FIGS. 12A to 12C are views illustrating the procedure of inserting a wire tip in a ninth embodiment into the pressure-bonding section.
Figure 12B:
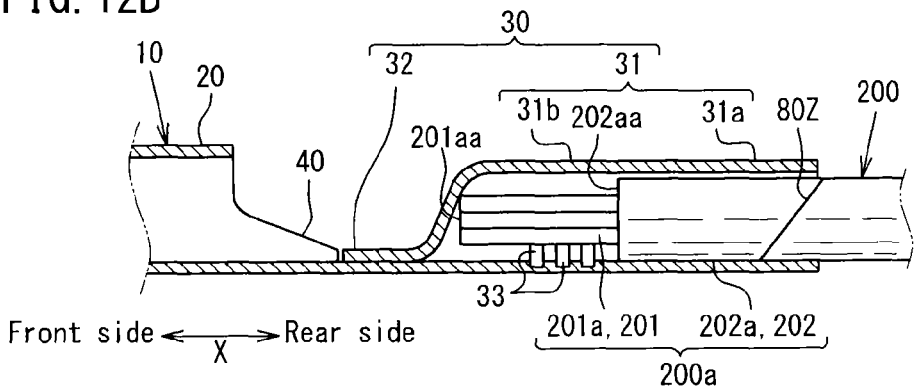
Figure 12C:
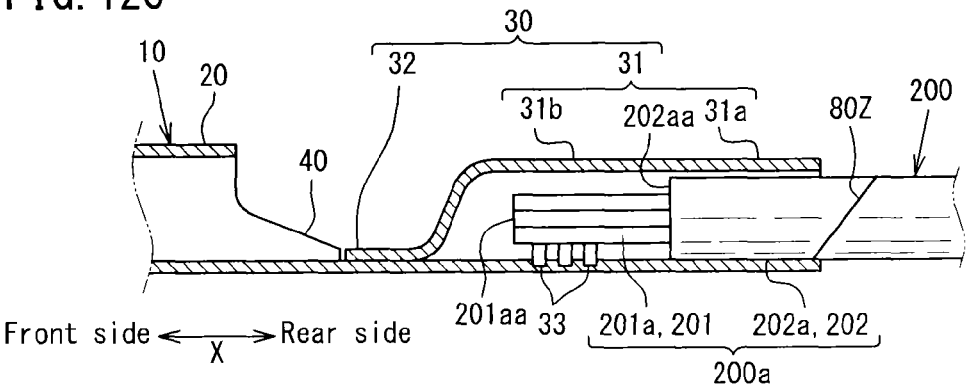

Although the linear sign 71 and the dashed sign 72 are marked on the outer circumferential face of the insulating cover 202 in the circumferential direction in the fourth embodiment, a linear sign 80Z that diagonally intersects the longitudinal direction X of the insulating cover 202 may be marked on the outer circumferential face of the insulating cover 202 as in a ninth embodiment shown in FIGS. 12A to 12C.

FIGS. 12A to 12C are views illustrating the procedure of inserting a wire tip 200*a* including the linear sign 80Z in the ninth embodiment into the pressure-bonding section 30. This will be described in more detail. FIG. 12A is a vertical sectional view showing the state where the wire tip 200*a* is inserted to the position where the center of the sign 80Z in the longitudinal direction X coincides with the opening-side rear end of the pressure-bonding section 30, FIG. 12B is a vertical sectional view showing the state where the wire tip 200*a* is inserted until the rear end of the sign 80Z is exposed from the pressure-bonding section 30, and FIG. 12C is a vertical sectional view showing the state where the wire tip 200*a* is inserted until the front end of the sign 80Z is hidden in the pressure-bonding section 30.

This will be described in more detail. The linear sign 80Z that diagonally intersects the longitudinal direction X of the insulating cover 202 is marked on the outer circumferential face of the insulating cover 202 of the insulated wire 200. A length from the front end to the rear end of the sign 80Z in the longitudinal direction X is set to a length corresponding to the range in which the conductor tip 201*a* of the aluminum core wire 201 is pressure-bonded to the conductor pressure-bonding section 31*b* of the pressure-bonding section 30 in the desired conductive state.

That is, the length of the sign 80Z is set to a length corresponding to the range in which the conductor tip 201*a* of the aluminum core wire 201 contacts the whole serrations including the serrations 33 of the conductor pressure-bonding section 31*b*.

Using the conductor tip face 201*aa* of the conductor tip 201*a* as a reference, the rear end of the sign 80Z is formed on the outer circumferential face of the insulating cover 202 at a distance of the internal length L of the pressure-bonding section 30 from the conductor tip face 201*aa*.

The front end of the sign 80Z is located in front of the rear end of the sign 80Z, and is formed on the outer circumferential face of the insulating cover 202 at a distance corresponding to the range in which the conductor tip 201*a* of the aluminum core wire 201 is pressure-bonded to the conductor pressure-bonding section 31*b* of the pressure-bonding section 30 in the desired conductive state, from the rear end toward the front end of the conductor.

The wire tip 200*a* of the insulated wire 200 on which the sign 80Z is marked is inserted into the pressure-bonding section 30 of the female crimp terminal 10 to the position where the sign 80Z intersects the opening-side rear end of the pressure-bonding section 30 as well as the center of the sign 80Z in the longitudinal direction X coincides with the opening-side rear end of the pressure-bonding section 30.

Thereby, the conductor tip 201*a* of the aluminum core wire 201 can be reliably inserted to the position where the conductor tip is properly pressure-bonded to the conductor pressure-bonding section 31*b* of the pressure-bonding section 30 without insufficient or excessive insertion of the wire tip 200*a* to the pressure-bonding section 30 (see FIG. 12A).

That is, when the conductor tip is inserted to the position where the sign 80Z formed on the insulating cover 202 of the wire tip 200*a* of the insulated wire 200 intersects the opening-side rear end of the pressure-bonding section 30 of the female crimp terminal 10, the front end of the sign 80Z is hidden in the pressure-bonding section 30, and the rear end of the sign 80Z is exposed from the opening-side rear end of the pressure-bonding section 30.

For this reason, by visually checking the sign 80Z exposed from the pressure-bonding section 30, one can reliably visually confirm that the conductor tip 201*a* of the aluminum core wire 201 is inserted to the predetermined position of the conductor pressure-bonding section 31*b* of the pressure-bonding section 30 from the outside of the pressure-bonding section 30.

Since the conductor pressure-bonding section 31*b* of the pressure-bonding section 30 in the female crimp terminal 10 is pressure-bonded to the conductor tip 201*a* of the aluminum core wire 201 of the wire tip 200*a* in the insulated wire 200 in this state, pressure-bonding into the predetermined pressure-bonding state can be achieved more reliably, realizing the substantially same actions and effects as in the above-described embodiments.

When the wire tip 200*a* is inserted into the pressure-bonding section 30, if the entire sign 80Z is invisible behind the pressure-bonding section 30, the wire tip 200*a* is excessively inserted into the pressure-bonding section 30. If the entire sign 80Z is exposed from the pressure-bonding section 30, the wire tip 200*a* is insufficiently inserted into the pressure-bonding section 30.

Accordingly, in inserting the wire tip 200*a* into the pressure-bonding section 30, the opening-side rear end of the pressure-bonding section 30 is inserted to fall within the range between the front end and the rear end of the sign 80Z in the longitudinal direction X, achieving good pressure-bonding.

For example, when the wire tip is inserted with the rear end of the sign 80Z exposed from the opening-side rear end of the pressure-bonding section 30 (see FIG. 12B), or until the front end of the sign 80Z is hidden behind the pressure-bonding section 30 (see FIG. 12C), the rear end of the sign 80Z is reliably exposed from the opening-side rear end of the pressure-bonding section 30.

For this reason, by visually checking the sign 80Z exposed from the pressure-bonding section 30, one can reliably visually confirm that at least the front end of the conductor tip 201*a* of the aluminum core wire 201 falls within the range in which the serrations of the conductor pressure-bonding section 31*b* can be pressure-bonded, from the outside of the pressure-bonding section 30. Therefore, pressure-bonding can be achieved such that the conductor tip 201*a* can contact the whole serrations of the conductor pressure-bonding section 31*b*.

Tenth Embodiment

Figure 13:
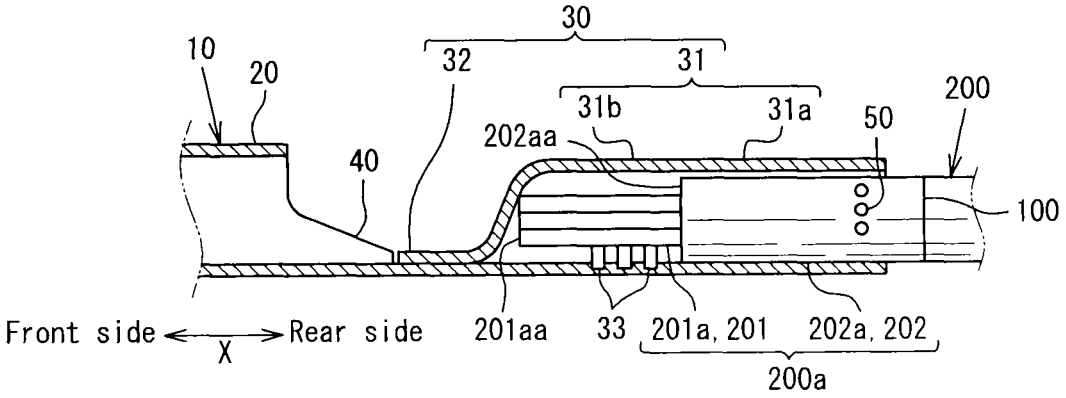
FIG. 13 is a view illustrating the procedure of inserting a wire tip in a tenth embodiment into the pressure-bonding section.

Although the signs 50 are marked to ensure that the conductor tip 201*a* of the aluminum core wire 201 is inserted to the predetermined position in the pressure-bonding section 30 in the first embodiment, a linear auxiliary sign 100 may be marked on the outer circumferential face of the insulating cover 202 exposed from the opening-side rear end of the pressure-bonding section 30 as in a tenth embodiment shown in FIG. 13.

FIG. 13 is a view illustrating the procedure of inserting a wire tip 200*a* including the linear auxiliary sign 100 in the tenth embodiment into the pressure-bonding section 30. This will be described in more detail. This figure is a vertical sectional view showing the state where the wire tip 200*a* is inserted into the pressure-bonding section 30 until the signs 50 are hidden.

This will be described in more detail. The linear auxiliary sign 100 is marked on the outer circumferential face of the insulating cover 202 exposed from the opening-side rear end of the pressure-bonding section 30 in the circumferential direction when the signs 50 are marked using a laser marker.

That is, even when the wire tip 200*a* of the insulated wire 200 is inserted into the pressure-bonding section 30 of the female crimp terminal 10 too much and thus, the signs 50 marked on the insulating cover 202 are invisible behind the pressure-bonding section 30, by visually checking the auxiliary sign 100 attached to the exposed outer circumferential face of the insulating cover 202, one can confirm that the signs 50 are provided in the invisible place hidden by the pressure-bonding section 30, from the outside of the pressure-bonding section 30.

Accordingly, even when the wire tip 200*a* of the insulated wire 200 is not pulled out of the pressure-bonding section 30 of the female crimp terminal 10, one can reliably visually confirm that the signs 50 are marked, from the outside of the pressure-bonding section 30.

The auxiliary sign 100 may be marked on a part of the exposed outer circumferential face of the insulating cover 202.

For correspondence between the configuration of the present invention and the embodiments, a crimp terminal of the present invention corresponds to the female crimp terminal 10 in the embodiments, a pressure-bonding section corresponds to the pressure-bonding section 30 of closed-barrel type, a conductor corresponds to the aluminum core wire 201, a rear sign corresponds to the signs 51, 51X, 61, 71, a front sign corresponds to the signs 52, 52X, 62, 72, a connection structural body corresponds to the pressure-bonding connection structural bodies 1*a*, 1*b*, a connector corresponds to the female connector 3*a* and the male connector 3*b*, and a tip face of the wire tip 200*a* corresponds to the conductor tip face 201*aa* of the conductor tip 201*a* and the insulated tip face 202*aa* of the insulated tip 202*a*.

However, the present invention is not limited to the configuration in the embodiments, and may be applied on the basis the technical concept recited in claims to implement many embodiments.

When the pressure-bonding section 30 of the female crimp terminal 10 is pressure-bonded to the wire tip 200*a* of the insulated wire 200, the insulating cover 202 extends rearward in the longitudinal direction X due to the pressure-bonding pressure acting on the pressure-bonding section 30. For this reason, for example, the signs 50 marked on the wire tip 200*a* move rearward with respect to the pressure-bonding section 30. In this case, when the wire tip 200*a* of the insulated wire 200 is inserted to the predetermined position in the pressure-bonding section 30, the signs 50 that would be otherwise located in the pressure-bonding section 30 may be exposed from the rear end of the pressure-bonding section 30 due to the extension of the insulating cover 202, which is caused by pressure-bonding.

Therefore, it is preferred that the signs 50 are located in consideration of the rearward extension of the insulating cover 202, which is expected by analyzing the behavior of the pressure-bonding section 30 at pressure-bonding by use of a predetermined analysis means not shown.

In the embodiments, the sign is located using the conductor tip face 201*aa* of the conductor tip 201*a* as a reference, and to remove a predetermined amount of the insulating cover 202 on the front-end side, the distance from the conductor tip face 201*aa* of the conductor tip 201*a* to the insulated tip face 202*aa* of the insulated tip 202*a* is uniform. Thus, the insulated tip face 202*aa* may be used as the reference.

Although the female crimp terminal 10 configured of the box section 20 and the pressure-bonding section 30 is used in the embodiments as described above, any crimp terminal having the pressure-bonding section 30 may be used, for example, a male crimp terminal configured of the insertion tab to be inserted into the box section 20 in the female crimp terminal 10 and the pressure-bonding section 30 may be used, and a crimp terminal configured of only the pressure-bonding section 30 to be connected to the plurality of bundled aluminum core wires 201 of the insulated wire 200 may be used.

The terminal connection structure of the insulated wire 200 of the present invention can be applied to a connection structure for pressure-bonding an opened-barrel type pressure-bonding section to the wire tip 200*a* of the insulated wire 200.

That is, one can visually confirm that the conductor tip 201*a* of the aluminum core wire 201 is inserted to a predetermined position in the opened-barrel type pressure-bonding section not shown from the outside of the pressure-bonding section, achieving the substantially same actions and effects as in the above-described embodiments.

In inserting the wire tip into the opened-barrel type pressure-bonding section, the sign may be marked on the conductor tip of the aluminum core wire exposed on the front-end side of the insulated wire.

The sign may be read using an optical sensor or an image reader.

Although the sign is marked by applying the laser radiated from the laser marker or printing or applying the ink using the marker or the ink-jet marker in the above-description, the sign may be marked by stamping on the insulated wire 200. However, when the sign is marked by stamping on the insulated wire 200, the flow of the insulated wire 200 in the production line is stopped once, and the insulating wire is pinched with a stamp. Thus, the marking through application of the laser or the ink has a higher productivity because the insulated wire 200 remains flowing.

DESCRIPTION OF REFERENCE SIGNS

1: Wire with female crimp terminal
1*a*, 1*b*: Pressure-bonding connection structural body
3*a*: Female connector
3*b*: Male connector
10: Female crimp terminal
20: Box section
30: Pressure-bonding section
31: Wire pressure-bonding section
31*b*: Conductor pressure-bonding section
32: Sealing portion

33: Serration
50, 51, 51X, 52, 52X: Sign
61, 62, 71, 72: Sign
80, 80X, 80Z, 90: Sign
100: Auxiliary sign
200: Insulated wire
200*a*: Wire tip
201: Aluminum core wire
201*a*: Conductor tip
201*aa*: Conductor tip face
202: Insulating cover
202*a*: Insulated tip
202*aa*: Insulated tip face
300: Connector housing

The invention claimed is:

1. An insulated wire-terminal connection structure comprising:

an insulated wire formed by covering a conductor with an insulating cover, the insulated wire having a wire tip formed by stripping an front end of the insulating cover to expose the conductor; and a crimp terminal having a pressure-bonding section that allows at least pressure-bonding of the wire tip, the insulated wire and the crimp terminal being pressure-bonded to each other via the pressure-bonding section, wherein a tip-side of an outer circumferential face of the insulating cover has a sign indicating that the wire tip is inserted into the pressure-bonding section by a predetermined length according to an insertion length of the wire tip into the pressure-bonding section for reference when inserting the wire tip into the pressure-bonding section for pressure-bonding, the sign is made of a material that is more flexible than the insulating cover, formed by stripping the insulating cover by a length less than the internal length of the pressure-bonding section and forming the sign after the stripping at a position located at a predetermined distance from a conductor tip face of the exposed conductor, arranged to cover the outer circumferential face of the insulating cover in a circumferential direction so as to be wide in a long length direction of the insulated wire, has a width including a position at a distance of the internal length of the pressure-bonding section from a tip face of the wire tip, the width corresponding to a range in which a conductor tip of the exposed conductor is pressure-bonded to the pressure-bonding section in a desired conductive state, and the wire tip inserted up to the sign is pressure-bonded to the pressure-bonding section and an area of the pressure-bonding section of the crimp terminal is pressed such that inner surfaces of the pressure-bonding section in the area contact with each other and the area of the pressure-bonding section of the crimp terminal is sealed, the area of the pressure-bonding section being in front of the tip face of the wire tip on a side of the crimp terminal.

2. The insulated wire-terminal connection structure according to claim 1, wherein the pressure-bonding section is formed into a hollow shape having an inner space capable of receiving the wire tip inserted, the hollow shape capable of surrounding the wire tip.

3. The insulated wire-terminal connection structure according to claim 2, wherein a front end of the pressure-bonding section is provided with a sealing portion sealed by adhering opposed inner faces of the pressure-bonding section to each other.

4. The insulated wire-terminal connection structure according to claim 1, wherein the conductor is made of an aluminum-based material, and at least the pressure-bonding section is made of a copper-based material.

5. A wire harness in which the crimp terminal of the terminal connection structure according to claim 1 is arranged in a connector housing.

6. The insulated wire-terminal connection structure according to claim 1, wherein the pressure-bonding section is a closed-barrel type pressure-bonding section.

7. The insulated wire-terminal connection structure according to claim 1, wherein the area of the pressure-bonding section of the crimp terminal is pressed such that an area of the wire tip after the wire tip is inserted up to the sign is not pressed and that there is a space not pressed in front of the tip face of the wire tip on the side of the crimp terminal.

8. The insulated wire-terminal connection structure according to claim 1, wherein the area of the pressure-bonding section of the crimp terminal is pressed such that water is prevented from entering into the pressure-bonding section from the area of the pressure-bonding section in front of the tip face of the wire tip on the side of the crimp terminal.

9. The insulated wire-terminal connection structure according to claim 1, wherein the area of the pressure-bonding section of the crimp terminal is pressed such that the area is flattened.

10. The insulated wire-terminal connection structure according to claim 9, wherein the area of the pressure-bonding section of the crimp terminal is pressed such that the area is flattened into a substantially flat plate shape.

11. The insulated wire-terminal connection structure according to claim 1, wherein the sign marked by irradiating a laser from a laser marker.

12. An insulated wire-terminal connection method comprising:

stripping, to form a wire tip of an insulated wire, a front end of an insulating cover covering a conductor to expose the conductor, the wire tip being configured of a conductor tip formed by the stripping by a predetermined length and an insulated tip in the rear of the conductor tip of the insulating cover;

after the stripping, in an outer circumferential face of the insulated tip, forming a sign at a position located at a predetermined distance from a conductor tip face of the conductor tip, and located at a distance corresponding to an insertion length of the wire tip into a pressure-bonding section of a crimp terminal from a tip face of the wire tip, the insulating cover having a length less than the internal length of the pressure-bonding section;

after the forming, inserting the wire tip of the insulated wire into the pressure-bonding section of the crimp terminal up to the sign to pressure-bond the insulated wire to the crimp terminal via the pressure-bonding section; and after the inserting, pressure-bonding the wire tip inserted up to the sign to the pressure-bonding section, wherein an area of the pressure-bonding section of the crimp terminal is pressed such that inner surfaces of the pressure-bonding section in the area contact with each other and the area of the pressure-bonding section of the crimp terminal is sealed, the area of the pressure-bonding section being in front of the tip face of the wire tip on a side of the crimp terminal.

13. The insulated wire-terminal connection method according to claim 12, wherein the inserting inserts the wire tip into a closed-barrel type pressure-bonding section of the crimp terminal.

14. The insulated wire-terminal connection method according to claim 12, wherein the area of the pressure-bonding section of the crimp terminal is pressed such that an area of the wire tip after the wire tip is inserted up to the sign is not pressed and that there is a space not pressed in front of the tip face of the wire tip on the side of the crimp terminal.

15. The insulated wire-terminal connection method according to claim 12, wherein the area of the pressure-bonding section of the crimp terminal is pressed such that water is prevented from entering into the pressure-bonding section from the area of the pressure-bonding section in front of the tip face of the wire tip on the side of the crimp terminal.

16. The insulated wire-terminal connection method according to claim 12, wherein the area of the pressure-bonding section of the crimp terminal is pressed such that the area is flattened.

17. The insulated wire-terminal connection method according to claim 16, wherein the area of the pressure-bonding section of the crimp terminal is pressed such that the area is flattened into a substantially flat plate shape.

18. The insulated wire-terminal connection method according to claim 12, wherein the sign marked by irradiating a laser from a laser marker.

* * * * *